US006758545B2

(12) United States Patent
Ikeda et al.

(10) Patent No.: US 6,758,545 B2
(45) Date of Patent: Jul. 6, 2004

(54) RECORDING DEVICE AND SORTER

(75) Inventors: Koji Ikeda, Sanda (JP); Hiroyuki Matsuo, Neyagawa (JP); Atsushi Sogami, Sanda (JP); Masaichiro Takekawa, Minoo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 192 days.

(21) Appl. No.: 10/057,285

(22) Filed: Jan. 25, 2002

(65) Prior Publication Data

US 2002/0101467 A1 Aug. 1, 2002

(30) Foreign Application Priority Data

Jan. 26, 2001 (JP) ..... 2001-017903
Jan. 26, 2001 (JP) ..... 2001-017929
Jan. 26, 2001 (JP) ..... 2001-017932

(51) Int. Cl.[7] ..... B41J 29/38; B41J 02/01

(52) U.S. Cl. ..... 347/16; 347/101; 347/104; 347/5

(58) Field of Search ..... 347/101, 104, 347/96, 95, 16, 5, 2, 4; 399/111, 406, 405; 358/296, 300, 401

(56) References Cited

U.S. PATENT DOCUMENTS 5,208,640 A * 5/1993 Horie et al. ..... 399/110
5,596,416 A * 1/1997 Barry et al. ..... 399/381
5,764,263 A * 6/1998 Lin ..... 347/101
5,859,711 A * 1/1999 Barry et al. ..... 399/83
6,474,806 B2 * 11/2002 Terauchi et al. ..... 347/16

FOREIGN PATENT DOCUMENTS

JP 04073666 A 3/1992

* cited by examiner

*Primary Examiner*—Stephen D. Meier
*Assistant Examiner*—Manish Shah
(74) *Attorney, Agent, or Firm*—Harness, Dickey & Pierce, P.L.C.

(57) ABSTRACT

First to third recording units 11–13, each of which is made up of a recording part 2 for recording an image on a record sheet 4 and a feeding part 3 for feeding a record sheet 4 to the recording part 2, are driven concurrently to share the processing of recording image data ranging over two or more record sheets 4. A delivering part 5 loads record sheets 4, which have been image recorded in the recording unit 11–13, onto specific bins 51–56 so that the record sheets 4 are stacked together on top of one another in a specific sequence.

32 Claims, 21 Drawing Sheets

RECORDING DEVICE AND SORTER

BACKGROUND OF THE INVENTION

1. Field of the Invention

The present invention belongs in the technical field of recording devices for recording an image on a record medium according to image data.

2. Description of the Prior Art

A network system of the type, in which two or more recording devices are connected to a network thereby to enable a user to use any one of these recording devices, has been known in the past (for example see Japanese Patent Kokai Publication No. H11-316671). In such a networking environment, a user outputs image data to a certain one of the recording devices via the network and the recording device makes a record of images.

Recently, there has been a growing demand for high-speed image recording. However, the achievement of an image recording rate of satisfactory level with a single recording device is considerably costly. To cope with this problem, the following approach may be possibly taken. That is, the above-described networking environment enables a user to use two or more recording devices. For example, the image data is divided into image data portions and these divided image data portions are individually output to the respective recording devices. To sum up, the speed-up of image recording can be achieved by concurrent driving of two or more recording devices.

However, in the aforesaid networking environment, each recording device is usually installed at some distance away from another. This is troublesome because, when two or more recording devices are assigned respective recording jobs by a user, the user has to go the round of these recording devices to fetch the image-recorded record media. It is possible to provide high-speed image recording by concurrent driving of two or more recording devices in the way described above; however, it is not user-friendly.

In recent years, the frequency at which color documents are handled has increased in many cases. For the case of recording devices of the ink jet type that print by expelling ink on the record sheet, it is possible to optimize the recording of black-and-white images and the recording of color images by making changes in the form of using such recording devices (i.e., by making changes in the type of ink or record sheet) between the recording of a black-and-white image and the recording of a color image.

Therefore, there are two possible approaches of preparing a mixed document of black-and-white image pages and color image pages.

The first approach employs two or more recording devices. More specifically, pages containing black-and-white images are prepared by a recording device the form of use of which is optimized for the recording of black-and-white images. On the other hand, pages containing color images are prepared by another recording device the form of use of which is optimized for the recording of color images.

On the other hand, the second approach employs only one recording device. More specifically, the form of use of the recording device is optimized for the recording of black-and-white images, and pages containing black-and-white images are prepared. Thereafter, the form of use of the recording device is changed and optimized for the recording of color images, and pages containing color images are prepared.

However, the first approach employing two or more recording devices is very troublesome because the user is required to go the round of the respective recording devices to fetch their outputs (i.e., image-recorded record media), which is not user-friendly at all. Besides, the user has to reorder the fetched, image-recorded record sheets in their proper sequence.

The second approach employing only one recording device is also very troublesome because the user is required to change the form of use of the recording device whenever the need arises. In addition to such troublesomeness, the user has to collate the image-recorded record sheets.

Bearing in mind the above-described disadvantages with the prior art techniques, the present invention was made. Accordingly, an object of the present invention is to provide a user-friendly recording device.

SUMMARY OF THE INVENTION

With a view to achieving the aforesaid object, the following inventions are provided. A first invention is directed to a recording device which is so configured as to record an image on a record medium according to image data. The recording device of the first invention comprises two or more recording parts for recording an image on a record medium, at least one feeding part for supplying record media to each recording part, and a delivering part for holding image-recorded record media delivered from each of the plural recording parts.

The recording device of the first invention is characterized in that the plural recording parts concurrently record images on different record media so that the processing of image data ranging over two or more record media can be shared between the plural recording parts.

Preferably, the delivering part is so configured as to hold record media, which have been image recorded in each of the plural recording parts, in such a way that the image-recorded record media are stacked on top of one another in a specific sequence. By "stacking image-recorded record media on top of one another in a specific sequence" here, what is meant is that the image-recorded record media are collated in a sequence designated by a user, when recording different images on two or more record media. Accordingly, when recording, on two or more record media, the same image, there is no limitation to the order in which these plural record media are arranged. Stated another way, the record media can be arranged in any random sequence.

In the way described above, two or more recording parts are driven concurrently with one another, whereby records of images on different record media can be made concurrently in the plural recording parts. This enables the plural recording parts to share the processing of image data ranging over two or more record media. Therefore, the time taken to make a record of images is shortened in proportion to the number of recording parts that are driven concurrently, as a result of which the speed-up of image recording can be achieved. Besides, in comparison with the case of achieving a certain recording rate with a recording device provided with only one recording part, the equal recording rate can be achieved at lower costs.

Further, the delivering part is configured to store record media, which have been image recorded in each of the plural recording parts, in such a way that the image-recorded record media are stacked on top of one another in a specific sequence. As a result of such arrangement, without having to go the round of two or more recording devices to fetch the record media, the user can conveniently fetch them (the record media in the form of a bunch) stored in the delivering part. That is, even when two or more recording parts are driven concurrently, it seems to the user that they function as a single recording device. This therefore considerably improves the convenience of the recording device at the time of use thereof. Further, each recording part may share the processing of image data in the following way. That is, the recording device automatically divides the image data into image data portions and each recording part is assigned a respective image data portion. Alternatively, the user himself may specify the allocation of such image data portions to each recording part.

Preferably, the delivering part includes a bin capable of moving between the plural recording parts to receive thereon record media delivered out of each recording part, and is configured such that record media, which have been image recorded in each of the plural recording parts, are stacked on top of one another in a specific sequence on the bin by causing the bin to move in association with the time of completion of the recording of an image in each recording part.

Two or more recording parts are driven concurrently with one another and, as a result, images are recorded on record media in the respective recording parts. At this time, the bin of the delivering part moves between the plural recording parts in association with the time of completion of the recording of an image in each recording part. As a result, the bin is sequentially loaded with an image-recorded record medium delivered from each recording part. The bin is loaded with a bunch of record media stacked on top of one another in a specific sequence. Therefore, what is required for the user to do is simply fetching the bunch without having to bother to rearrange the image-recorded record media in their proper sequence. This improves the convenience of the recording device at the time of use thereof.

Preferably, the delivering part includes (a) two or more bins respectively corresponding to the plural recording parts on which record media delivered out of each recording part are loaded and (b) a transferring means for transferring a record medium between the plural bins, and is configured such that record media, which have been image recorded in each of the plural recording parts, are loaded on the plural bins corresponding to the plural recording parts, and stacked together, by causing the transferring means to transfer the image-recorded record media onto a specific bin of the plural bins, on top of one another in a specific sequence on the specific bin.

Two or more recording parts are driven concurrently with one another and, as a result, images are recorded on record media in the respective recording parts. At this time, the plural bins of the delivering part are each loaded with an image-recorded record medium delivered out of their corresponding recording parts. Thereafter, the record medium loaded on each bin is transferred onto a specific bin by the transferring means. The "specific bin" can be any one of the plural bins. In this way, a bunch of record media stacked on top of one another in a specific sequence is formed on a single bin (a specific one of the plural bins). Therefore, what is required for the user to do is simply fetching the bunch. This improves the convenience of the recording device at the time of use thereof.

It is preferable that, when any one of the plural recording parts is incapable of recording an image, another one of the plural recording parts capable of image recording records the image on a record medium in place of the faulty recording part. This invention is an invention for improving the convenience of the recording device, especially in networking environment.

That is, in a typical networking environment, a user, who is usually at some distance away from where a recording device is installed, outputs image data to the remote recording device via the network. Therefore, even when a recording part of the recording device becomes incapable of image recording due to some errors such as for example lack of ink or toner, paper jam, recording part failure, and so forth, the user may remain unaware of any error. In this case, the faulty recording part incapable of image recording may be left as it is and there is a possibility that the image data remains unprocessed. Because of this, even when another user outputs new image data, it is not processed. As a result, the recording device may become unavailable.

To cope with the above inconvenience, when any one of the plural recording parts is incapable of recording image data, another recording part capable of image recording processes the image data in place of that faulty recording part. As a result of such arrangement, image data, output by a user, can be processed in any one of the recording parts without fail. Because of this, possible inconveniences in the foregoing networking environment will be eliminated, therefore improving the convenience of the recording device.

Preferably, only one mains plug for supplying electric power to each recording part is provided. This facilitates the installation of a recording device comprising two or more recording parts.

Further, when only one mains plug is provided, it is preferable that each recording part is configured in the form of a unit and is capable of being stacked together on top of one another, and that each unit-like recording part is electrically connected to the mains plug when stacked together on top of one another.

As a result of such arrangement, a power supply circuit of the recording device can be formed by merely stacking together two or more unit-like recording parts on top of one another. This therefore further facilitates the installation of a recording device comprising two or more recording parts.

Further, when only one mains plug is provided, it is preferable that the plural recording parts are configured such that the timing at which the power consumption of each recording part increases to a maximum is differed from that of every other recording part by mutual adjustment of the operating timing of recording an image in each recording part. As a result of such arrangement, even for the case of a recording device provided with two or more recording parts, its rated power can be reduced.

Further, it is preferable that a single power supply switch for switching on and off the supply of electric power to the recording parts is provided and electric power is supplied to all of the recording parts by switching on the power supply switch.

As a result of such arrangement, all of the recording parts can switch between a "use" state and a "not use" state by just operating the single power supply switch, thereby providing improved convenience.

Alternatively, it is preferable that power supply switches are provided in association with the recording parts and electric power is supplied, by switching on each power supply switch, to its corresponding recording part.

As a result of such arrangement, for example when any one of the plural recording parts becomes incapable of image recording or when a user wants to use only some of the plural recording parts, the user is able to stop the supply of electric power to a recording part that is out of order or not needed by turning off its corresponding power supply switch. This offers not only improved convenience but also improved energy-saving and safety.

Further, it is preferable that the recording device further comprises a single displaying means for displaying recording part operating states, wherein the displaying means is so configured as to display the operating state of all of the recording parts.

Alternatively, it is preferable that the recording device further comprises two or more displaying means for displaying recording part operating states which are provided in association with the recording parts, wherein each displaying means is so configured as to display the operating state of its corresponding recording part. Here, "the recording part operating state" includes for example record sheet jam, lack of ink or toner, faulty recording part, and so forth.

If the operating state of all the recording parts is displayed by a single displaying means, this allows a user to grasp the operating state of all the recording parts by looking at the displaying means. This therefore provides improved convenience.

On the other hand, if the operating state of each recording part is displayed by its corresponding displaying means, this allows a user to easily grasp the operating state of any one of the plural recording parts by looking at its corresponding displaying means.

Further, it is preferable that power supply switches for switching on and off the supply of electric power to the recording parts are provided in association with the recording parts, and each displaying means, even when the power supply switch of its corresponding recording part is switched off, is so configured as to be able to display the operating state of the corresponding recording part.

This is an invention which is effective when a plurality of users share a recording device. For example, the displaying means of a recording part whose power supply switch is being turned off because of failure still can display a message indicating that the recording part is now out of order. This enables a user to easily grasp the reason of why the recording part in question is being turned off by just looking at the displaying means.

Instead of implementing the displaying means by using for example a liquid crystal panel capable of electrically displaying a message, the displaying means may be so configured as to be able to mechanically display a message, by which even when the power supply switch is turned off it is possible to display the operating state of the recording part.

Furthermore, the plural recording parts each may have two operating modes one of which is a first mode in which the plural recording parts share the processing of image data and the other of which is a second mode in which each recording part individually processes image data.

That is, for example, even when the recording device is shared between a plurality of users, there is such a situation that a certain user wants to exclusively use one recording part. In such a case, the recording device is operated in the second mode, whereby a record of images can be made in any one of the plural recording parts. Otherwise, the recording device is operated in the first mode. The first mode offers high-speed image recording because the plural recording parts share the processing of image data. Preferably, switching between the first mode and the second mode can be made selectively by the user. For instance, an arrangement may be made in which the recording device is provided with a single first input part, and a second input part for each recording part, as input parts which are fed image data from a user. When the image data is input to the first input part, the recording device is operated in the first mode. On the other hand, when the image data is input to any of the second input parts, the recording device is operated in the second mode. In this way, the recording device can be switched between the first mode and the second mode depending on which of the first and second input parts is fed image data from the user.

The provision of the first and second modes diversifies the utilization manner of the recording device. This enables a user to select an adequate one from among a variety of utilization manners, thereby improving the convenience of the recording device.

Apart from the above, for example Japanese Patent Kokai Publication No. H04-73666 discloses a recording device in which unit-like recording parts for making a record of images on the record sheet are stacked on top of one another in an up and down direction. This is space-saving, and it is possible to form a recording device provided with two or more recording parts of the foregoing type by stacking together these recording parts on top of one another in an up and down direction.

Further, each of the foregoing recording units may be implemented by an ink jet recording unit which makes a record of images on a record medium by emitting ink onto the record medium according to image data.

However, recording units of the ink jet type require an ink tank for holding ink that is expelled onto a record sheet. Further, when an ink tank runs out of ink, the empty ink tank must be replaced with a new ink tank. Accordingly, recording units of the ink jet type require characteristic maintenance work, i.e., the replacement of an ink tank. Because of this, recording devices, comprising two or more recording units vertically stacked together on top of one another, must be configured and designed so as to facilitate the replacement of an ink tank in each recording unit.

Bearing in mind such a requirement, a second invention was made. More specifically, the second invention is intended for an ink jet recording device that is configured so as to record, by emitting ink onto a record medium according to image data, an image on the record medium, wherein two or more unit-like recording parts, each of which is provided with a recording part having an ink jet head for emitting ink, are stacked together on top of one another in an up and down direction.

The ink jet recording device of the second invention is characterized in that an opening, through which maintenance work is performed on each unit-like recording part, is formed in a side of each unit-like recording part.

It is possible to achieve the space saving of an ink jet recording device by vertically stacking together two or more unit-like recording parts on top of one another.

Furthermore, by virtue of the formation of an opening in the side of each unit-like recording part, the inside of all the unit-like recording parts is made accessible. Because of this, for example a lowermost unit-like recording part can be maintained with ease.

It is preferable that the ink jet recording device further comprises an access cover capable of opening and closing the opening of each unit-like recording part, and each unit-like recording part is provided with a respective access cover.

Alternatively, the plural unit-like recording units may be provided with a single common access cover.

Here, "the maintenance work on each unit-like recording part" may be the replacement of an ink tank when each unit-like recording part is provided with an ink tank for holding therein ink that is supplied to its ink jet head.

Furthermore, in the case each unit-like recording part is provided with a sub tank formed integrally with its ink jet head and a main ink tank connected to the sub tank, "the maintenance work on each unit-like recording part" may be the replacement of the main ink tank.

Further, in the case each unit-like recording part is provided with a feeding part for accommodating a record medium and for feeding the record medium to its recording part, "the maintenance work on each unit-like recording part" may be the supply of record media to the feeding part.

When the recording device comprises two or more ink jet unit-like recording parts and each unit-like recording part is provided with a respective ink tank, each recording part requires the replacement of an ink tank. This is troublesome and not user-friendly.

Bearing in mind the above-described inconvenience, a third invention was made. More specifically, the third invention is directed to an ink jet recording device which is so configured as to record, by emitting ink onto a record medium according to image data, an image on the record medium. The ink jet recording device of the third invention is characterized in that it comprises two or more recording parts each of which is provided with an ink jet head for emitting ink and a single ink tank for holding ink that is supplied to each ink jet head.

As a result of such arrangement, even when ink is emitted from more than one ink jet head, troublesome work, such as the replacement of an ink tank for each recording part, is eliminated because the number of ink tanks for holding ink is one.

As describe above, when only one ink tank is provided to two or more ink jet heads, it is required that the ink jet heads be connected to the ink tank by ink tubes. In such an arrangement, the ink held in the ink tank is drawn into the ink jet heads by pressure (negative pressure) produced when each ink jet head shoots ink.

However, the ink suction pressure of each ink jet head varies according to the difference in vertical position between each ink jet head and the ink tank. Because of this, when considering for example the case in which two or more unit-like recording parts are vertically stacked together on top of one another, the position of height to the ink tank differs from one ink jet head to another, as a result of which the ink suction pressure also differs from one ink jet head to another. This may cause interference with the suction of ink. In this case, there is a possibility that the quality of an image recorded in the recording unit deteriorates.

In order to eliminate such image quality deterioration, the plural recording parts may horizontally be arranged side by side so that the ink jet heads of the recording parts are positioned at approximately the same height with respect to the ink tank.

As a result of such arrangement, ink suction pressures in the ink jet heads become approximately the same. This smoothens the ink suction of each ink jet head, as a result of which deterioration in image quality can be avoided.

On the other hand, when two or more recording parts are stacked together on top of one another in an up and down direction, it is preferable that the ink jet recording device further comprises an adjusting means for providing adjustment so that ink suction pressures in the ink jet heads of the plural recording parts become approximately the same.

If two or more recording parts are stacked together on top of one another in vertical direction, this causes the position of height of each ink jet head to the ink tank to differ from one ink jet head to another. As a result, ink suction pressures in the ink jet heads differ from one another. However, by virtue of the adjusting means, ink suction pressures in the ink jet heads are held approximately the same. Therefore, each ink jet head comes to have approximately the same ink suction pressure.

The adjusting means may be configured as follows. That is, the ink jet heads are connected to the ink tank by different supplying tubes and the ink tank is vertically divided into two or more ink chambers corresponding to the supplying tubes. Besides, each pair of adjacent ink chambers are communicated together through a respective switch valve. The adjusting means comprises mounting holes for the supplying tubes, the mounting holes being positioned in the ink chambers at such heights that vertical distances between the mounting holes and their corresponding ink jet heads are approximately the same, and the switch valves which are placed in the closed state at least during ink emission in the ink jet head.

As a result of such arrangement, vertical distances between the ink jet heads of the recording parts and the mounting holes of the corresponding ink chambers are held approximately the same. Further, at the time of ink emission, each ink chamber provided with such a mounting hole becomes independent of every other ink chamber because the switch valves are placed in the closed state. As a result, ink suction pressures in the ink jet heads become approximately the same.

It is preferable that the opening and closing of the switch valves is controlled such that all of the switch valves are not placed in the opened state at the same time during non ink emission in the ink jet head.

As a result of such arrangement, the opening and closing of the switch valves is controlled during non ink emission, and the ink chambers are communicated together at staggered timings. Because of this, although the ink tank has more than one ink chamber, approximately the same configuration as that of a single ink tank can be achieved.

Further, for example if all of the plural switch valves are placed in the opened state at the same time to cause all the ink chambers to communicate with one another, the ink pressure of the lowermost ink tank (the pressure with respect to the direction in which ink flows from the ink tank to each ink jet head) increases because the plural ink chambers are defined in an up and down direction. Because of this, there is a possibility that ink leaks from the ink jet head connected to the lowermost ink chamber through the mounting hole and the ink supplying tube.

To cope with this problem, the opening and closing of the switch valves is controlled such that all of the switch valves are not placed in the opened state at the same time. The ink pressure of each ink chamber (especially, the ink pressure of the lowermost one) is controlled so as not to increase, and the leaking of ink from the ink jet head can be avoided.

Serial ink jet recording has been known in the art, in which ink is emitted while causing an ink jet head to reciprocate with respect to a record medium.

In a recording part of the serial ink jet recording type, however, there occurs vibration by inertial force resulting from the reciprocating movement of the ink jet head. Because of this, if two or more recording units of the serial ink jet recording type are vertically stacked together on top of one another, this means that the number of ink jet heads that reciprocate is two or more, and there is a possibility that the degree of vibration resulting from such reciprocating movement increases to a further extent. Therefore, certain measures must be taken with a view to avoiding such a possibility.

Bearing in mind the above, a fourth invention was made. More specifically, the fourth invention is directed to an ink jet recording device which is so configured as to record, by emitting ink onto a record medium according to image data, an image on the record medium. The ink jet recording device of the fourth invention comprises two or more recording parts each of which is provided with an ink jet head capable of emitting ink onto a record medium while reciprocating with respect to the record medium.

The ink jet recording device of the fourth invention is characterized in that the plural recording parts are stacked together on top of one another in an up and down direction so that the ink jet heads of the recording parts can reciprocate in the same direction, and the recording parts are configured such that the ink jet heads of the recording parts are reciprocated out of phase with respect to each other so as to reduce vibration due to the reciprocating movement of the ink jet heads.

As described above, the ink jet heads are reciprocated out of phase with respect to each other so that inertial forces resulting from the reciprocating movement of each ink jet head are balanced. Because of this, the reduction of vibration due to the reciprocating movement of the ink jet heads can be achieved.

Further, it is preferable that the recording parts are configured such that, when each recording part makes no record of images, its corresponding ink jet head is reciprocated, without ink emission, out of phase with respect to the reciprocating movement of the other ink jet heads.

That is, for example when the number of recording parts of the plural recording parts that are making a record of images is only one, the number of ink jet heads that are reciprocating is only one. In such a case, inertial forces resulting from the reciprocating movement of each ink jet head cannot be balanced, and it is impossible to reduce resulting vibration. Accordingly, the balancing of inertial forces requires that two or more ink jet heads be reciprocated. Because of this, when inertial forces cannot be balanced, e.g., when the number of ink jet heads that are reciprocating for making a record of images is only one, another ink jet head that is not reciprocating because it is not required to make a record of images is forced to reciprocate out of phase with respect to the ink jet head that is being reciprocated for making a record of images. As a result of such arrangement, inertial forces can be balanced.

When the delivering part for holding image-recorded record media delivered from a recording part has two or more bins, it may be functioned as a sorter capable of sorting record media delivered from the recording part, for example by set or by page. Stated another way, if record media delivered from the recording part are loaded on different bins, this makes it possible to sort the record media.

Further, when a plurality of users share a recording device connected to a network, the sorter may be configured so as to have a new function of sorting record media by output case by loading record media on different bins by image data output from each user.

However, even when the sorter is configured so as to be able to sort record media by output case, a user, who sent image data to a recording device in the networking environment, is usually at some distance from the recording device, as mentioned above. Since every user does not always fetch image-recorded record media loaded on a bin at once, the record media may be left on the bin for a while. If other users output image data to the recording device by turns, image-recorded record media output from the recording device would not be fetched by the users and left on each bin.

If new image data are output to the recording device even when each bin is loaded with record media, there are two alternatives to take. In the first alternative, image recording is brought into a stop until the record media loaded on any one of the bins are removed therefrom. In the second alternative, record media relating to the new image data are loaded on a bin already loaded with the other record media relating to the previous image data. The first alternative, in which the processing of making a record of images is stopped until the record media loaded on any one of the bins are removed, is troublesome because the user is required to remove record media on the bin. On the other hand, in the second alternative in which new record media are loaded on a bin that has already been loaded with the other record media, the sorter has no longer a function of sorting record media by output case. After all, none of the first and second alternatives are user-friendly.

Further, when two or more bins are arrayed side by side in an up and down direction, record media that are newly delivered are preferably loaded on an uppermost one of the vertically arranged bins when taking into account user convenience. However, the record media loaded on the bin are fetched at random by users, which means that the uppermost bin is not always empty. Because of this, at the time when new image data are output to the recording device, record media relating to the new image data must be loaded on an empty one of the plural bins vertically arranged. Because of this, it is difficult for a user to locate which bin is loaded with a record medium relating to the image data output by him. This is not user-friendly.

Bearing in mind the above, a fifth invention was made. More specifically, the fifth invention is directed to a sorter with two or more bins each having an upward loading surface on which a record medium is loaded, wherein record media, which have been image recorded in recording parts, are loaded on the different bins so that the record media are sorted.

The sorter of the fifth invention is characterized in that it further comprises a transferring means for transferring a record medium between the plural bins. Here, the plural bins may be arranged vertically side by side or may be arranged horizontally.

The transferring means is capable of transferring a record medium between two or more bins, and when a record medium is loaded on a specific bin it is possible to place the specific bin in the empty state by transferring that record medium onto another bin. Because of this, for example when new image data is output to the recording part and a record medium relating to the image data is delivered from the recording part, such a specific bin is first placed in the empty state and then the record media is loaded on the specific bin. As a result of such arrangement, any record medium that is newly delivered (a most recent record medium) can be loaded on the specific bin without fail.

Further, record media can be transferred by the transferring means, which makes it possible to avoid such a situation that record media are left on all the bins. Because of this, when sorting record media by output case, such situations that image recording is stopped until any one of the bins is emptied and that a bin, which has already been loaded with a record medium, is loaded with another record medium, can be avoided. Here, such a specific bin that is to be placed in the empty state by the transfer of a record medium may be any bin capable of allowing a user to easily remove a record medium loaded thereon (for example, the uppermost one when two or more bins are arranged vertically). As a result of such arrangement, record media that are newly delivered are always loaded on a bin capable of allowing a user to easily remove a record medium loaded thereon, thereby providing further improved convenience to the user.

Furthermore, if, when transferring a record medium on the specific bin onto another bin by the transferring means, this destination bin has been already loaded with other record media, it may be arranged such that the record media on the destination bin are transferred by the transferring means onto still another bin. As a result of such arrangement, it is possible to place the specific bin in the empty state whenever required, and it is also possible to load different bins with record media by output case. This therefore enables a user to easily locate which of the bins is loaded with a record medium relating to the image data output from him, thereby providing improved convenience.

When the plural bins are arranged side by side in an up and down direction, the transferring means may be so configured as to cause a record medium on the loading surface of each bin to drop down for transferring the record medium to another bin directly underlying each bin.

The transferring means for allowing a record medium to drop down for transferring same may comprise a pair of wall members which are arranged face to face with each other, the pair of wall members being movable so as to switch between a proximity state in which the wall members are brought into close proximity to each other to form the bin loading surface and a clearance state in which the wall members are moved away from each other so as to allow a record medium to drop down.

Alternatively, the transferring means may comprise a wall member which is pivotably supported on one side end of each bin so that the wall member is rotatable so as to switch between a state in which the bin loading surface is formed and a state in which a record medium is allowed to drop down.

Further, the transferring means may comprise a pair of wall members which are arranged face to face with each other, the pair of wall members being expandable and contractible so as to switch between an expanded state in which the wall members expand in the direction in which the wall members move toward each other to form the bin loading surface and a contracted state in which the wall members contract in the direction in which the wall members move away from each other so as to allow a record medium to drop down.

Furthermore, when the sorter is configured such that record media are collated by output case in most-to-least-recent order on the vertically arranged bins (the order is from the uppermost bin to the lowermost bin) by configuring the transferring means such that a record medium is transferred between two or more bins by allowing the record medium to drop down and, in addition, that record media that are newly output are always loaded on the uppermost bin, a storing part for storing image-recorded record media may be positioned under a lowermost one of the plural bins.

As a result of such arrangement, record media, record-processed in the recording part and left for a long time since then, will be transferred sequentially from the uppermost bin to the intermediate bin, and finally to the lowermost bin. At this time, it is possible to further transfer the record media loaded on the lowermost bin to its underlying storing part. Because of this, such a state that record media are loaded on all of the plural bins can be avoided, and it is possible to not only sort record media by output case but also load record media that are newly delivered from the recording part on the uppermost bin.

Preferably, a lowermost one of the plural bins is so configured as to serve also as a storing part for storing image-recorded record media.

Further, when a record medium is transferred between two or more bins by the transferring means, it is preferable that a displaying means is positioned in each bin or in the vicinity of each bin, the displaying means displaying an indication that specifies a record medium loaded on the bin loading surface, and that each displaying means is so configured as to change its display contents in association with the transferring of the record medium.

As a result of such arrangement, even when record media are transferred between two or more bins, a user is able to easily locate a record medium relating to the image data output by him, just by looking at an indication displayed by the displaying means.

The above will be described through example. Each displaying means is so configured as to be able to display any one of sings "A"–"E" and, when a user outputs image data to the recording part, the user is notified of any one of the signs "A"–"E" (for example, the sign "A"). Together with this, it is arranged such that the sign "A" is displayed on a displaying means corresponding to a bin on which a record medium relating to the image data output by the user is loaded.

When the record medium on the bin whose corresponding displaying means is displaying the sign "A" is transferred to another bin by the transferring means, a displaying means corresponding to the destination bin now displays the sign "A". On the other hand, the displaying means which previously displayed the sign "A" is now made to display other than the sign "A". The arrangement that each displaying means is so configured as to change its display contents in association with the transferring of a record medium enables a user, even when a record medium relating to the image data output by the user is transferred, to locate a bin loaded with the record medium, because its corresponding displaying means is now displaying the sign "A". In this way, even when a record medium relating to the image data output by a user is transferred between two or more bins, it is possible for a user to easily specify his record medium, thereby improving convenience.

A six invention is directed to a sorter, in which two or more bins each having an upward loading surface on which a record medium is loaded are arranged side by side, for loading record media, which have been image recorded in recording parts, on the different bins so that the record media are sorted. The sorter of the sixth invention is characterized in that the bins are each movably configured so that the order in which the bins are arranged can be changed.

The plural bins are each movably configured so that they can be rearranged in their position, thereby making it possible to cause an empty bin carrying thereon no record medium to move to a specific arrangement position, for example when delivering a new record medium from the recording part. As a result, any bin positioned at such a specific arrangement position can constantly be placed in the empty state.

As a result of such arrangement, it becomes possible to always deliver new image-recorded record media onto a bin (an empty bin) positioned at the specific arrangement position, thereby improving convenience.

Here, each bin may be shifted so that record media are collated by output case in most-to-least-recent order. This enables a user to easily locate which of the bins is loaded with a record medium relating to the image data output by the user, thereby improving convenience.

When each bin is movably configured as described above, each bin may be provided with a retaining means for retaining a record medium loaded on the bin loading surface during bin movement.

That is, when a bin loaded with record media is moved, there is a possibility that a record medium drops down from the bin by disturbance such as for example wind. To cope with this, record media are held by the retaining means, so that, even when a bin with a load of record media is moved, the record media are positively prevented from dropping down from the bin loading surface.

DESCRIPTION OF PREFERRED EMBODIMENTS OF THE INVENTION

Figure 1:
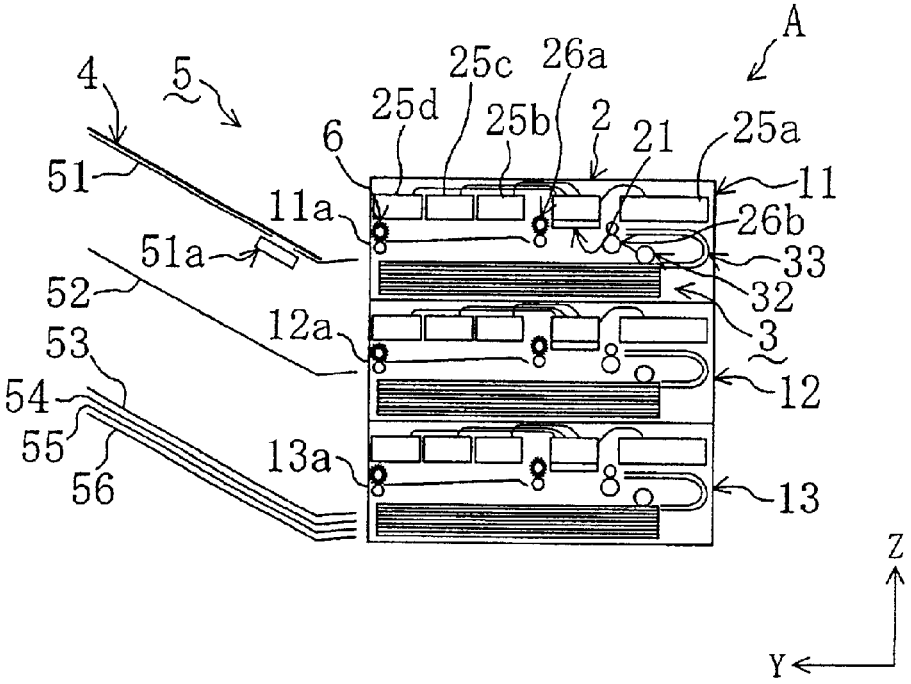
FIG. 1 is a diagram showing an arrangement of a recording device according to an embodiment of the present invention.

Referring to the drawing figures, embodiments of the present invention will be described below.

FIG. 1 shows a recording device A as an embodiment of the present invention. The recording device A includes two or more recording units approximately shaped like the box (three recording units in the figure, namely first to third recording units 11–13). Each recording unit 11–13 is made up of a recording part 2 for recording, on a record sheet 4, an image according to the image data and a feeding part 3 for feeding record sheets 4 to the recording part 2. In each of the recording units 2 a record of images is made, and the recording device A further includes a delivering part 5 for holding record sheets 4 delivered from each recording unit 11–13.

Each recording unit 11–13 can be stacked together on top of one another in an up and down direction (the Z-direction in the figure). The recording device A is formed by stacking together the first recording unit 11, the second recording unit 12, and the third recording unit 13 on top of one another in that order in the Z-direction. Formed in sides of the recording units 11–13 are delivering outlets 11*a*–13*a* by which record sheets 4, which have been image recorded in the recording parts 2, are let out. These three recording units 11–13 are positioned such that their delivering outlets 11*a*–13*a* open on the same side.

The delivering part 5 has two or more bins (six bins in the figure, namely first to sixth bins 51–56) which are loaded with record sheets 4. With respect to the first to third recording units 11–13 stacked together in the Z-direction, the bins 51–56 are disposed laterally to the opening side of the delivering outlets 11*a*–13*a*.

The number of recording units (the recording units 11–13) is not limited to three. The number of bins (the bins 51–56) which are provided to the delivering part 5 is not limited to six.

Further, the feeding part 3 is not necessarily provided for each recording unit 11–13. An arrangement may be made in which at least one feeding part 13 is provided and record sheets 4 are fed from the single feeding part 13 to the recording part 2 of each recording unit 11–13.

The recording device A is configured such that, when performing the processing of image data ranging over two or more record sheets 4, the recording parts 2 of the recording units 11–13 concurrently record images on different record sheets 4 while the delivering part 5 stacks together record sheets 4, which have been image recorded in the recording parts 2, on top of one another in a specific sequence, details of which will be described later.

Configuration of the Recording Part

The recording part 2 of each of the recording units 11–13 is of the ink jet type. Each recording part 2 is equipped with an ink jet head 21 for making a record of color images by shooting inks of different colors (i.e., black, yellow, cyan, and magenta) onto the record sheet 4.

The ink jet head 21 is provided with a piezoelectric actuator (not shown). The ink jet head 21 is of the on-demand type, wherein each of the inks held in individual pressure chambers is expelled through the nozzles by driving the piezoelectric actuator at a desired timing. The type of the ink jet head 21 is not limited to the on-demand type. Other than the on-demand type may be used.

Figure 2:
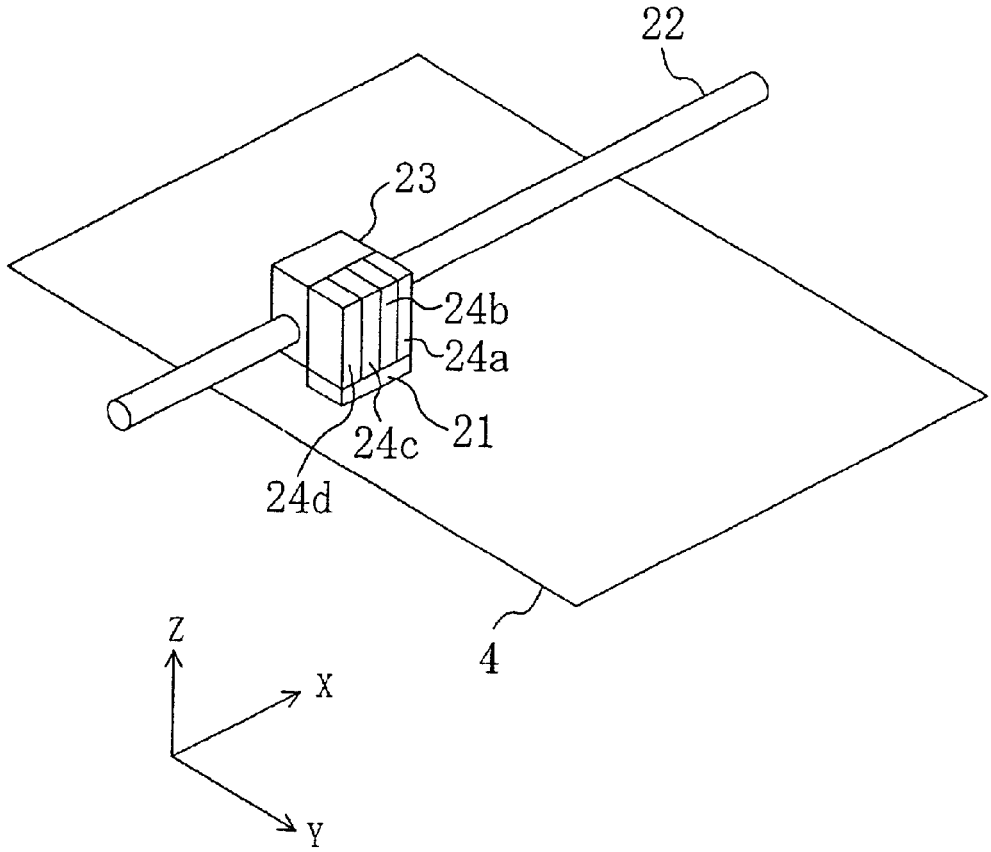
FIG. 2 is a perspective view showing an arrangement of a carriage part.
Figure 3:
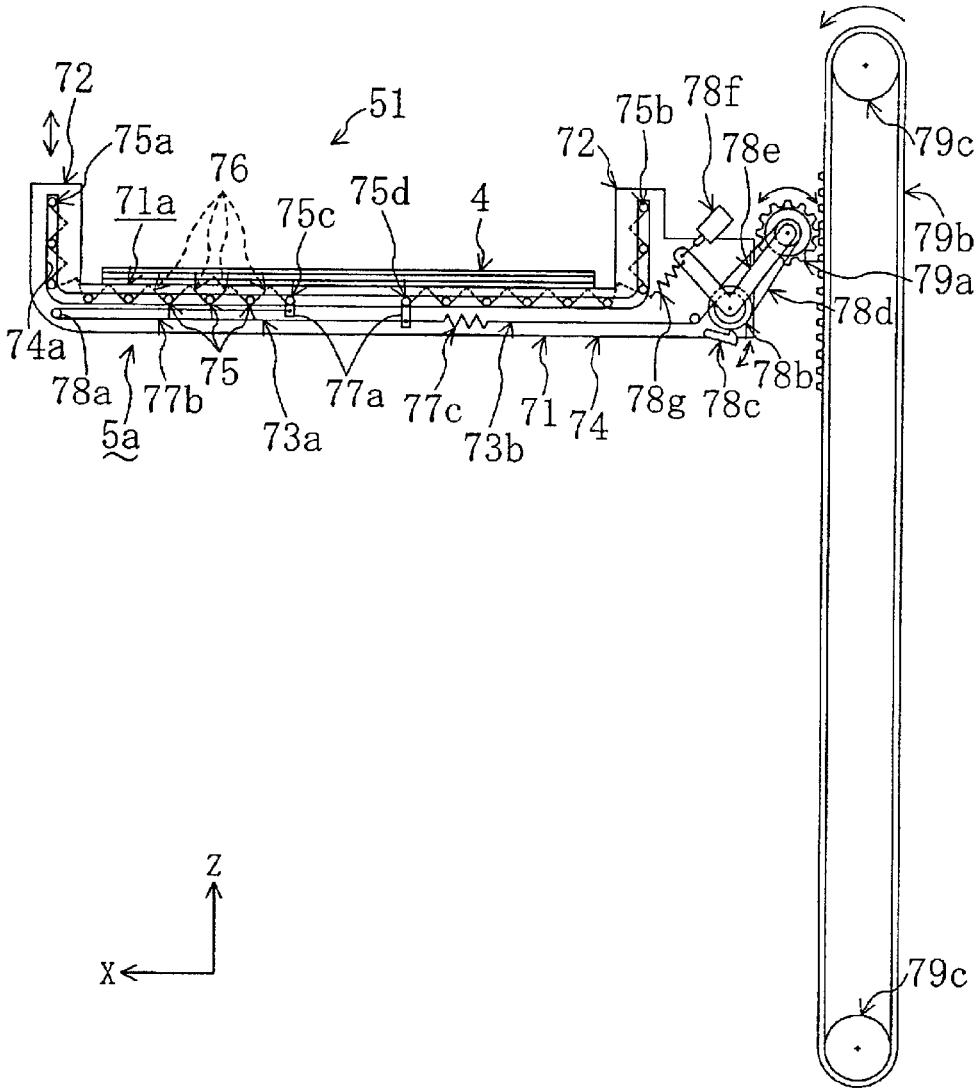
FIG. 3 is a side view showing a bin in the record sheet loadable state.
Figure 4:
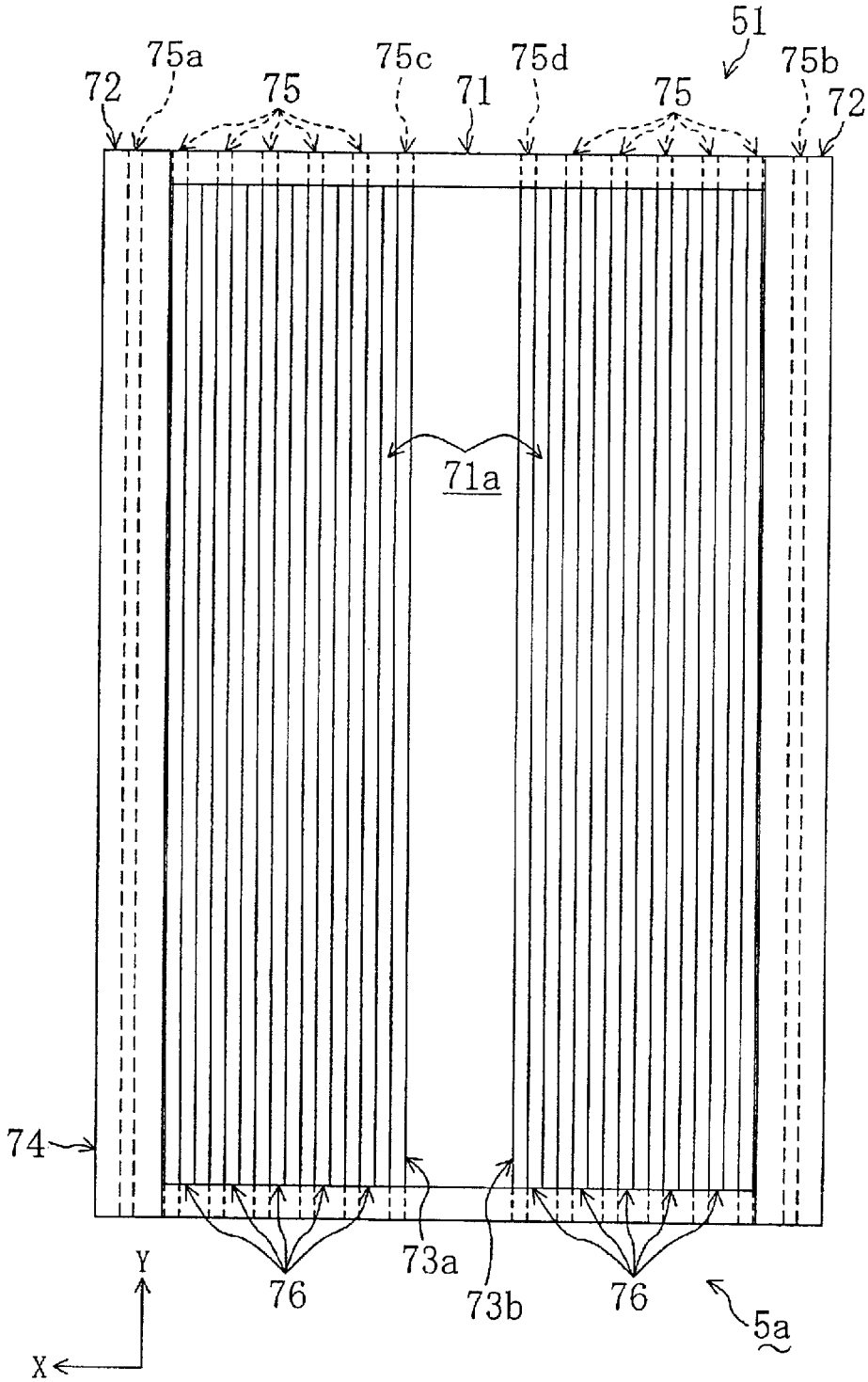
FIG. 4 is a top view showing a bin in the record sheet loadable state.
Figure 5:
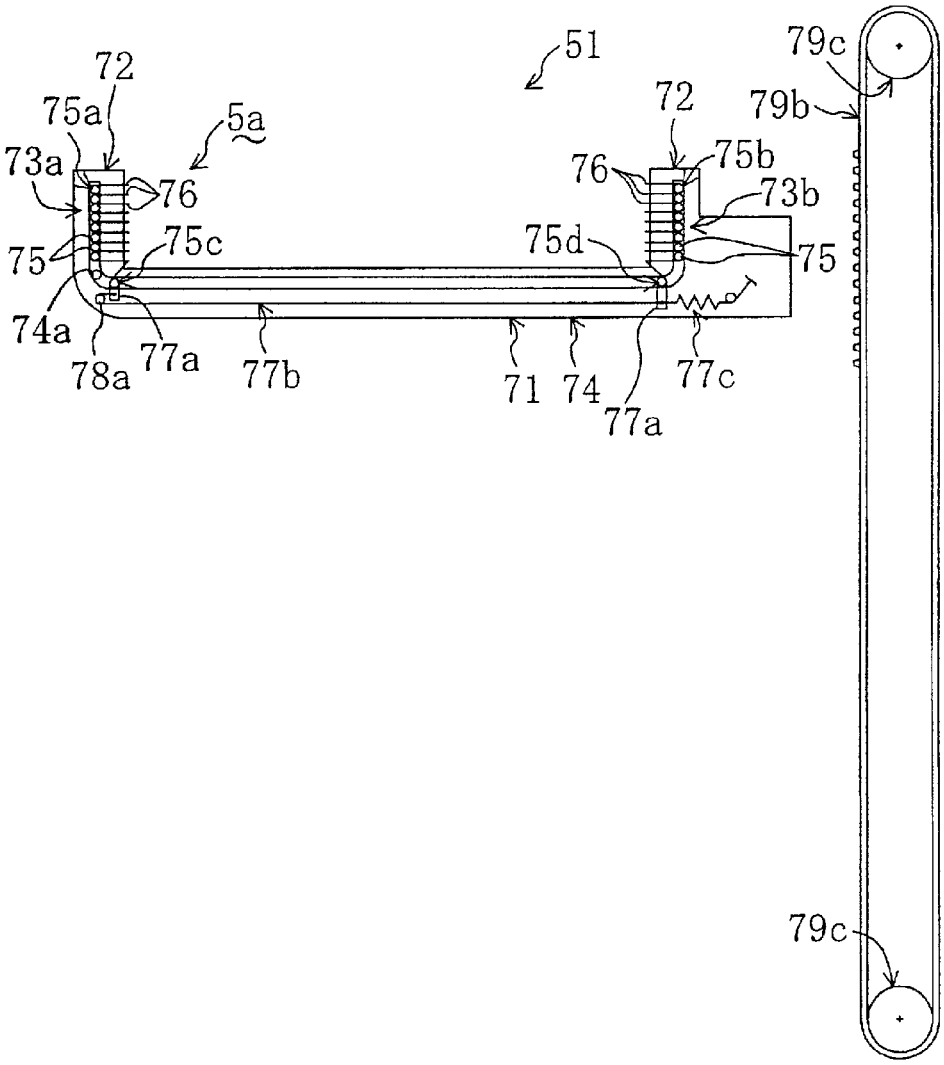
FIG. 5 is a diagram corresponding to FIG. 3, but showing a bin in the record sheet transferable state.
Figure 6:
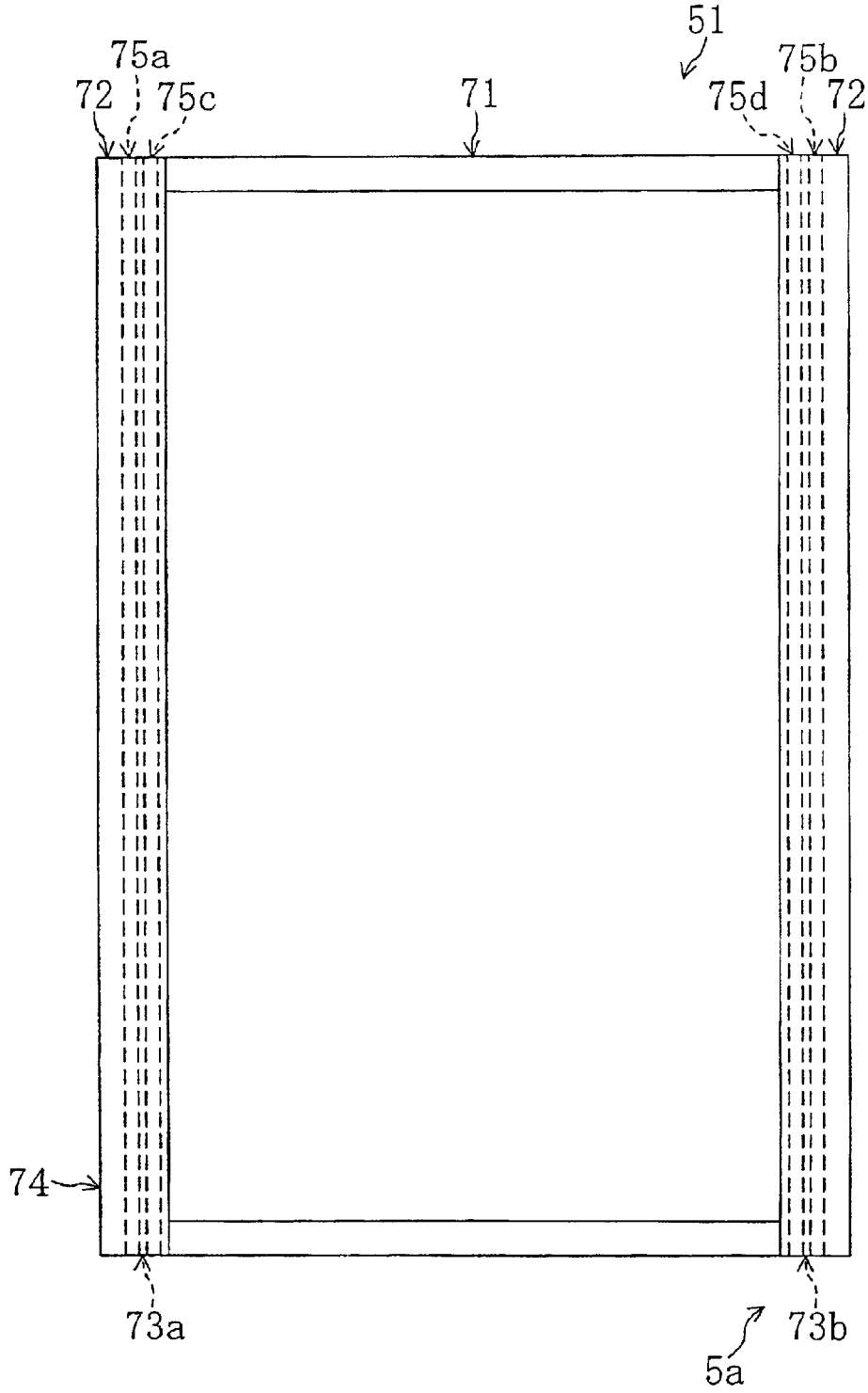
FIG. 6 is a diagram corresponding to FIG. 4, but showing a bin in the record sheet transferable state.

As illustrated in FIG. 2, the ink jet head 21 is fixedly supported on a carriage 23. Being guided by a carriage shaft 22 extending in the primary scanning direction (in the X-direction of FIG. 2), the carriage 23 reciprocates in the X-direction. The carriage shafts 22 of the first to third recording units 11–13 are so disposed as to extend in the same direction (i.e., the X-direction), and the ink jet heads 21 (the carriages 23) of the first to third recording units 11–13 reciprocate in the same direction (the X-direction).

Attached to the carriage 23 are reserve ink tanks 24*a*–24*d* individually holding respective inks (black, yellow, cyan, and magenta) which are supplied to their corresponding pressure chambers. The reserve ink tanks 24*a*–24*d* are connected to main ink tanks 25*a*–25*d* (see FIG. 1) individually holding their respective inks (black, yellow, cyan, and magenta) by supplying tubes. To sum up, in the recording device A, the sub tanks 24*a*–24*d* and the main ink tanks 25*a*–25*d* are provided for each of the recording units 11–13. When the ink of any one of the main ink tanks 25*a*–25*d* is consumed, the empty main ink tank is replaced with a new one.

The way of supplying ink to the ink jet head 21 is not limited to the above configuration. An alternative arrangement may be made in which only one ink tank, which is mounted on the carriage 23 and reciprocates together with the carriage 23, is provided so that ink is directly supplied to the ink jet head 21 from that ink tank.

Further, a conveying roller 26*a* on the record sheet delivering side and a conveying roller 26*b* on the record sheet feeding side, disposed so as to face each other across the ink jet head 21 with respect to the secondary scanning direction (the Y-direction of FIGS. 1 and 2) orthogonal to the primary scanning direction, are provided to convey the record sheet 4 in the Y-direction. The conveying rollers 26*a* and 26*b* each comprise a pair of rollers. The pair of rollers pinch the record sheet 4 therebetween and convey it in the Y-direction. As a result, the record sheet 4 is passed under the ink jet head 21.

By virtue of such arrangement, the recording part 2, while causing the carriage 23 and the record sheet 4 to travel in the X-direction and in the Y-direction, respectively, shoots droplets of ink toward the record sheet 4 to form a desired image thereon.

Configuration of the Feeding Part

The feeding part 3 is equipped with a sheet feeding tray (not shown) in which many record sheets 4 are held and a pickup roller 32 for feeding the record sheets 4 held in the paper feeding tray, one record sheet at a time. The record sheet 4 delivered out of the sheet feeding tray, after passing through a sheet feeding path 33 connecting the pickup roller 32 and the sheet feeding side conveying roller 26*b*, is fed to the conveying roller 26*b*.

Positioned in the vicinity of the delivering outlets 11*a*–13*a* of the recording units 11–13 are delivering rollers 6 by which image-recorded record sheets 4 are let out through the delivering outlets 11*a*–13*a*.

Configuration of the Delivering Part

The delivering part 5 comprises the first to sixth bins 51–56 vertically disposed in that order in the Z-direction. Each of the bins 51–56 can be moved individually in the Z-direction by elevating means (not shown). This enables each of the bins 51–56 to travel between the delivering outlets 11*a*–13*a* of the recording units 11–13 for holding record sheets 4 delivered out of each of the recording units 11–13.

As shown in FIGS. 3–6, each of the bins 51–56 (the first bin 51 in the figures) has an upward loading surface 71*a* and is formed into a tray-like shape. Each bin is composed of a loading bottom wall 71 on which record sheets 4 are loaded and regulating vertical walls 72 and 72. The regulating vertical walls 72 and 72 extend upwardly from X-direction side end portions of the loading bottom wall 71, respectively, for regulating the dropping down of the record sheets 4 loaded on the loading bottom wall 71. The left-and right-hand sides toward the drawings in FIGS. 3–6 are referred to hereinafter as the X-direction left side and as the X-direction right side, respectively.

Both Y-direction side edge portions of the loading bottom wall 71 and both the regulating vertical walls 72 and 72 are formed by a frame 74. On the other hand, the Y-direction middle portion of the loading bottom wall 71 is composed of a pair of expandable and contractible members, namely a left bellows member 73*a* positioned on the X-direction left side and a right bellows member 73*b* positioned on the X-direction right side.

Each of the bellows members 73*a* and 73*b* comprises many rodlike core materials 75 extending in the Y-direction. Fold portions 76 are positioned between each pair of adjacent core materials 75 and 75 so that the core materials 75 are connected together to form each bellows member 73*a* and 73*b*.

Formed in the frame 74 is a guide groove 74*a* extending from the loading bottom wall 71 to the regulating vertical walls 72, and both the Y-direction ends of each core member 75 are internally inserted into the guide groove 74*a*. This therefore allows each core material 75 to move along the guide groove 74*a* in the X- and Z-directions. The X-direction leftmost core material 75 of the left bellows member 73*a* is fixed to an upper portion of the guide groove 74*a* formed in the regulating vertical wall 72 on the X-direction left side. On the other hand, the X-direction rightmost core material 75 of the right bellows member 73*b* is fixed to an upper portion of the guide groove 74*a* formed in the regulating vertical wall 72 on the X-direction right side.

As a result of such arrangement, when the left bellows member 73*a* and the right bellows member 73*b* are in their expanded state in which the core materials 75 of these bellows members 73*a* and 73*b* are placed apart from each other, an X-direction rightmost core material 75*c* of the left bellows member 73*a* and an X-direction leftmost core material 75*d* of the right bellows member 73*b* are placed apart from each other by a specific small distance. As a result, a loading surface 71*a*, onto which the record sheet 4 is loaded, is formed by the left and right bellows members 73*a* and 73*b* (see FIGS. 3 and 4).

On the other hand, when the left and right bellows members 73*a* and 73*b* are in their contracted state in which the core materials 75 of these bellows members 73*a* and 73*b* are brought into close proximity to each other, the X-direction rightmost core material 75*c* of the left bellows member 73*a* and the X-direction leftmost core material 75*d* of the right bellows member 73*b* are positioned in the vicinity of the X-direction left side regulating vertical wall 72 and in the vicinity of the X-direction right side regulating vertical wall 72, respectively. Because of this, part of the loading surface 71*a* is opened (see FIGS. 5 and 6).

The paired, expandable and contractible bellows members 73*a* and 73*b* together forming the loading bottom wall 71 of each of the bins 51–56 provide a transferring means 5*a*. The transferring means 5*a* transfers a record sheet 4 loaded on the loading surface 71*a* of one of the bins 51–56 by causing the record sheet 4 to be dropped down onto the loading surface 71*a* of another bin positioned directly under the one bin.

Next, an arrangement of expanding and contracting the bellows members 73*a* and 73*b* will be described. The X-direction rightmost core material 75*c* of the left bellows member 73*a* and the X-direction leftmost core material 75*d* of the right bellows member 73*b* are each provided with an attachment piece 77*a*. A first pulley 78*a* is positioned at an X-direction left end portion of the frame 74 and a second pulley 78*b* is positioned at an X-direction right end portion of the frame 74.

Of these two attachment pieces 77*a*, the attachment piece 77*a* of the left bellows member 73*a* is attached to a leading end of a wire member 77*b*. The wire member 77*b* is disposed such that it extends from the attachment piece 77*a* of the left bellows member 73*a* toward the X-direction left side, passes around the first pulley 78*a*, and extends toward the X-direction right side. A base end of the wire member 77*b* is wound around the second pulley 78*b*. However, a portion of the wire member 77*b* situated between the first and second pulleys 78*a* and 78*b* is attached to the attachment piece 77*a* of the right bellows member 73*b*. A tension spring 77*c* is positioned between an attachment portion of the wire member 77*b* to the attachment piece 77*a* of the right bellows member 73*b* and the second pulley 78*b*.

The second pulley 78*b* is provided with a stopper 78*c* which engages with the peripheral surface of the second pulley 78*b*. The stopper 78*c* is so constructed as to be switchable between an engagement state in which the stopper 78*c* engages with the second pulley 78*b* and a disengagement state in which the stopper 78*a* moves away from the second pulley 78*b* (see an arrow of FIG. 3). The rotation of the second pulley 78*b* is regulated in the engagement state. On the other hand, in the disengagement state the second pulley 78*b* is energized to rotate counterclockwise by a spring (not shown).

A third pulley 79*a* is disposed apart from the second pulley 78*b* by a specific distance, and a driving belt 78*d* is passed over the second and third pulleys 78*b* and 79*a*. Rotary motion of the third pulley 79*a* is transmitted to the second pulley 78*b* by the driving belt 78*d*.

The third pulley 79*a* includes a pulley portion around which the driving belt 79*a* is wound and a gear portion which has a turning center common to the pulley portion and rotates together with the pulley portion. The gear portion is configured so as to mesh with a timing belt 79*b* disposed aside, on the X-direction right side, to each bin 51–56 and extending in the Z-direction. The timing belt 79*b* is passed over a pair of pulleys 79*c* and 79*c* positioned apart from each other in the Z-direction. One of the pulleys 79*c* and 79*c* acts as a driving pulley by which the timing belt 79*b* is rotated counterclockwise (see an arrow of FIG. 3).

Attached to the third pulley 79*a* is one end of a crank 78*e* formed into the shape of an L. The L-shaped crank 78*e* is rockable about its bending portion. Because of this, the third pulley 79*a* is able to switch between an engagement state in which the third pulley 79*a* engages with the timing belt 79*b*and a withdrawal state in which the third pulley 79*a* is moved away from the timing belt 79*b*, with the rocking motion of the crank 78*e* (see an arrow of FIG. 3). Rocking control of the crank 78*e* is performed by a solenoid 78*f* and a tension spring 78*g* attached to the other end of the crank 78*e* (the end opposite, with respect to the bending portion, to the end on which the third pulley 79*a* is mounted). Normally, the rocking position of the crank 78*e* is positioned such that the third pulley 79*a* is placed in the withdrawal state by the tension spring 78*g*. On the other hand, the rocking position of the crank 79*a* is positioned such that the third pulley 79*a* is placed in the engagement state by activating the solenoid 78*f*.

When the timing belt 79*b* is rotated counterclockwise by placing the third pulley 79*a* in the engagement state, the third pulley 79*a* starts rotating clockwise and the second pulley 78*b* also rotates clockwise by the driving belt 78*d*. As a result, the wire member 77*b* is wound around the second pulley 78*d* and the X-direction rightmost core material 75*c* of the left bellows member 73*a* travels toward the X-direction left side, while on the other hand the X-direction leftmost core material 75*d* of the right bellows member 73*b* travels toward the X-direction right side. With the movement of these core materials 75*c* and 75*d*, the remaining other core materials 75 also travel. As a result, each bellows member 73*a* and 73*b* enter the contracted state in which each core material 75 of the left and right bellows members 73*a* and 73*b* becomes approximately adjacent to one another. Then, part of the loading surface 71 is opened (see FIGS. 5 and 6).

If the stopper 78*c* still remains engaged with the second pulley 78*b* even after the third pulley 79*a* is placed in the withdrawal state, with each bellows member 73*a* and 73*b* placed in their contracted state in which part of the loading surface 71*a* is opened, the clockwise rotary motion of the second pulley 78*d* is regulated. As a result, the part of the loading surface 71*a* remains in the opened state.

When the stopper 78*c*enters the disengagement state in which the stopper 78*c* is withdrawn from the second pulley 78*b*, the second pulley 78*b* is rotated counterclockwise by a spring, and the wire member 77*b* wound around the second pulley 78*b* is let out. As a result, the X-direction rightmost core material 75*c* of the left bellows material 73*c* travels toward the X-direction right side, while on the other hand the X-direction leftmost core material 75*d* of the right bellows member 73*b* travels toward the X-direction left side, and at the same time the other core materials 75 also travel. As a result, each of the left and right bellows members 73*a* and 73*b* enters the expanded state in which each core material 75 of the bellows members 73*a* and 73*b* is separated from one another. In this way, the loading surface 71*a* enters the sheet loadable state (see FIGS. 3 and 4). By virtue of the arrangement described above, each bellows member 73*a* and 73*b* is able to expand and contract.

As shown in FIG. 1, each of the first to sixth bins 51–56 is provided with a detecting means 51*a* for detecting whether or not the record sheet 4 is loaded thereon. In FIG. 1, only the detecting means 51*a* mounted on the first bin 51 is shown. The detecting means 51*a* may be implemented by for example a reflection type photosensor, composed of a light emitting portion for emitting light toward the record sheet 4 and a light receiving portion for receiving light reflected from the record sheet 4, for detecting the presence or absence of a record sheet from the presence or absence of such reflected light.

Configurations of the Other Parts

Configuration of Input Part of Recording Device A

Configurations of other parts of the recording device A will be described below. The recording device A is provided with both a first input portion and a second input portion (not shown) as an input portion to which image data are input. It is a user who determines which one of the first and second input portions is fed image data. If a user inputs image data to the first input portion, this causes the recording device A to operate in a first operation mode in which two or more recording units (recording parts 2) 11–13 share the processing of the input image data. On the other hand, if a user inputs image data to the second input portion, this causes the recording device A to operate in a second operation mode in which each of the recording units 11–13 individually performs the processing of the input image data. If a user wants to exclusively use one of the recording units 11–13, the user inputs image data to the second input portion. Other than such a case, a user inputs image data to the first input portion so as to cause the recording units 11–13 to share the processing of the input image data, thereby providing high-speed image recording.

Further, it is designed such that when any one of the first to third recording units 11–13 is unable to make a record of images (i.e., when there occurs a paper jam or lack of ink in any one of the recording units 11–13), another recording unit records images in place of the recording unit out of order. As a result of such arrangement, whenever image data is input, the input image data will be processed in any one of the recording units 11–13 without fail. This avoids such a situation that the input image data remain unprocessed.

Configuration for Power Supply in Recording Device A

Figure 7:
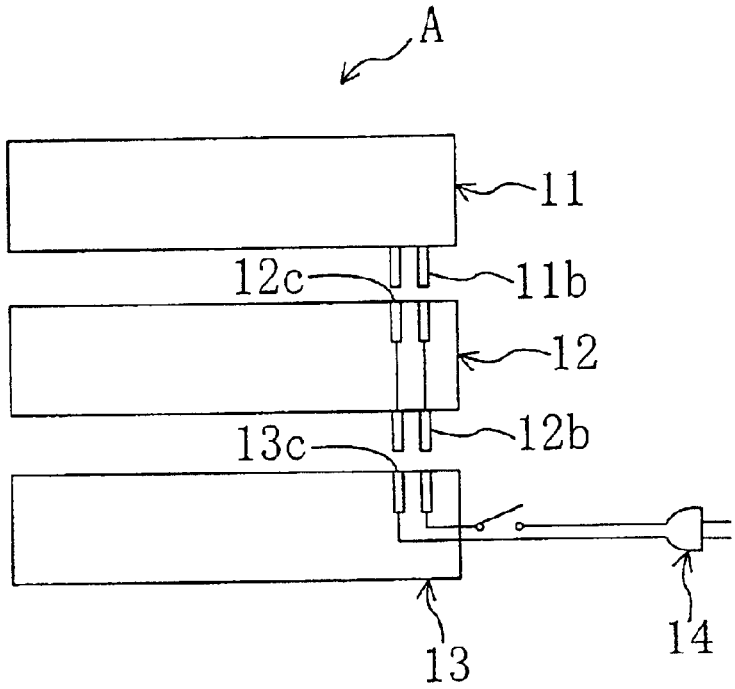
FIG. 7 is a schematic diagram showing an electric power supply circuit of the recording device.

A power supply circuit of the recording device A is configured as shown in FIG. 7. Convex electrodes 11*b*, which are electrically connected to the parts 2 and 3 of the first recording unit 11, are provided on a lower surface of the first recording unit 11, projecting downwardly therefrom. Formed in an upper surface of the second recording unit 12 are concave electrodes 12*c* that are opened thereat. On the other hand, convex electrodes 12*b*, which are electrically connected to the parts 2 and 3 of the second recording unit 12, are provided on a lower surface of the second recording unit 12, projecting downwardly. Concave electrodes 13*c*, which are electrically connected to the parts 2 and 3 of the second recording unit 12 as well as to a mains plug 14 for supplying power, are formed in an upper surface of the third recording unit 13, being opened thereat. The convex electrodes 11*b* and 12*b*, when inserted into the concave electrodes 12*c* and 13*c*, respectively, establish electrical connections therewith. As a result of such arrangement, the convex electrodes 11*b* and 12*b* can be inserted into the concave electrodes 12*c* and 13*c*, respectively, just by stacking the first to third recording units 11–13 on top of one another by turns, and the first to third recording units 11–13 are electrically connected to the mains plug 14.

The provision of the single mains plug 14 in the recording device A facilitates the installation of the recording device A made up of the plural recording units 11–13.

Further, the stacking together of the recording units 1113 allows them to be electrically connected to the mains plug 14, which further facilitates the installation of the recording device A.

Furthermore, positioned between the mains plug 14 and the electrode 13*c* of the third recording unit 13 is a power supply switch 15. When the power supply switch 15 is turned on, power is supplied to all the parts 2 and 3 of the recording units 11–13.

All of the recording units 11–13 can be switched between a "use" state and a "not use" state, just by operating the switch 15, thereby providing improved convenience.

Figure 8:
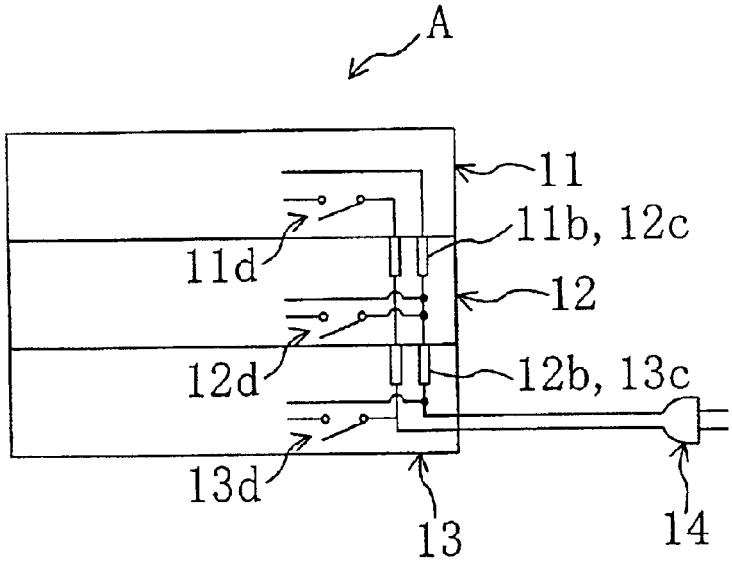
FIG. 8 is a diagram corresponding to FIG. 7, showing a recording device provided with power switches in association with respective image forming units.

The power supply switch 15 is not necessarily provided between the mains plug 14 and the electrode 13*c* of the third recording unit 13. FIG. 8 shows an alternative arrangement in which power supply switches 11*d*–13*d* are positioned between (a) the electrodes 11*b*, 12*b*, 12*c*, and 13*c* of the recording units 11–13 and (b) the parts 2 and 3 of each of the recording units 11–13, and by turning on each power supply switch 11*d*–13*d* a corresponding one of the recording units 11–13 is fed power.

When employing such an alternative arrangement, the user is allowed to individually turn on or off the power supply switches 11*d*–13*d* for the recording units 11–13 and it is possible for the user to stop a supply of electric power to an idle recording unit. This therefore improves energy saving and safety.

Additionally, the recording device A is configured such that the timing, at which the power consumption of each of the recording units 11–13 increases to a maximum, is differed from that of every other recording unit by mutual adjustment of the operating timing of recording an image in each of the recording units 11–13. This reduces the rated power of the recording device A.

Configuration of Display Device in Recording Device A

Figure 9:
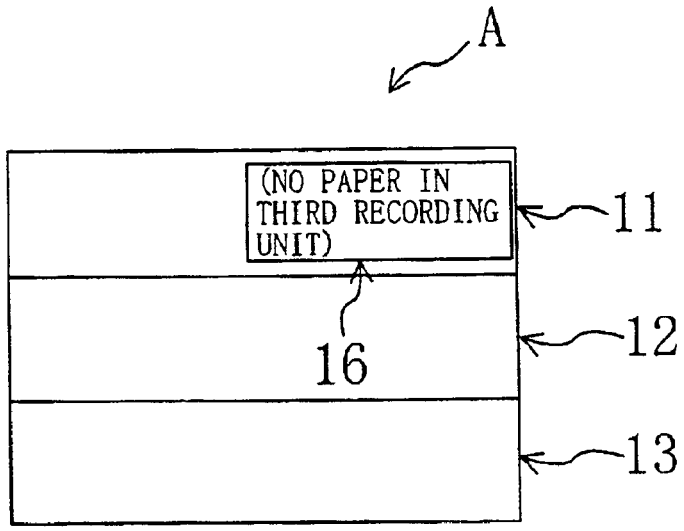
FIG. 9 is a schematic diagram showing a recording device provided with a single common display device.

The recording device A is provided with a display device 16, as shown in FIG. 9. The display device 16 displays the operating state of each of the recording units 11–13 such as "NO PAPER" (for example, when there is no record sheet 4 in the sheet feeding part 3 and "PAPER JAM" (for example, when paper jam is occurring in the sheet feeding part 3 or in the recording part 2). The display device 16 displays the operating state of all of the first to third recording units 11–13, such as for example a message of "NO PAPER IN THIRD RECORDING UNIT".

Figure 10:
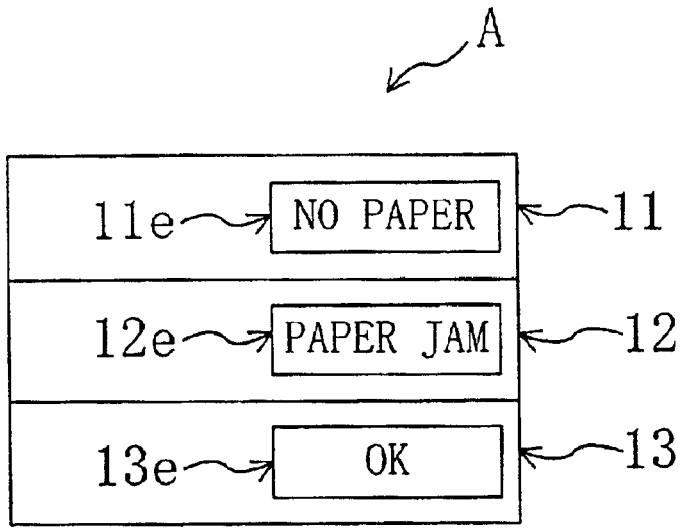
FIG. 10 is a diagram corresponding to FIG. 9, showing a recording device provided with display devices in association with respective image forming units.

Alternatively, display devices 11*e*–13*e* may be provided to the recording units 11–13, respectively, as shown in FIG. 10. The display devices 11*e*–13*e* display the operating states of their corresponding recording units 11–13, respectively. The display devices 16 and 11*e*–13*e* may be implemented by a liquid crystal panel or the like.

As described above, the operating state of all of the first to third recording units 11–13 is displayed on the single display device 16, thereby allowing a user to grasp their current operating states just by looking at the display device 16. This provides improved convenience.

On the other hand, the arrangement that the operating states of the recording units 11–13 are displayed on their corresponding display devices 11*e*–13*e* allows a user to easily grasp current operating states of the recording units 11–13 by looking at the display devices 11*e*–13*e*.

The display devices 16 and 11*e*–13*e* may be implemented by other than a liquid crystal panel. Further, when it is arranged such that, by turning on each power supply switch 11*d*–13*d*, a corresponding one of the recording units 11–13 is fed electric power (see FIG. 8) and that the display devices 11*e*–13*e* display the operating states of their corresponding recording units 11–13 (see FIG. 10), each display device 11*e*–13*e* may be configured so that, even when its corresponding one of the power supply switches 11*d*–13*d* of the recording units 11–13 is turned off, it can still display the operating states of its corresponding one of the recording units 11–13. This may be achieved by for example the provision of a buttery which supplies electric power necessary for the display devices 11*e*–13*e* to display the operating state of the recording units 11–13.

As a result of such arrangement, even when any one of the recording units 11–13 fails and a corresponding one of the power supply switches 11*d*–13*d* is turned off accordingly, each display device 11*e*–13*e* will remain able to display a message informing that its corresponding recording unit is being out of order. Because of this, a user can easily understand the reason of why a particular one of the recording units 11–13 is being turned off. Such arrangement is especially effective when the recording device A is shared among a plurality of users.

Arrangement for the Maintenance of Recording Units 11–13

Figure 11:
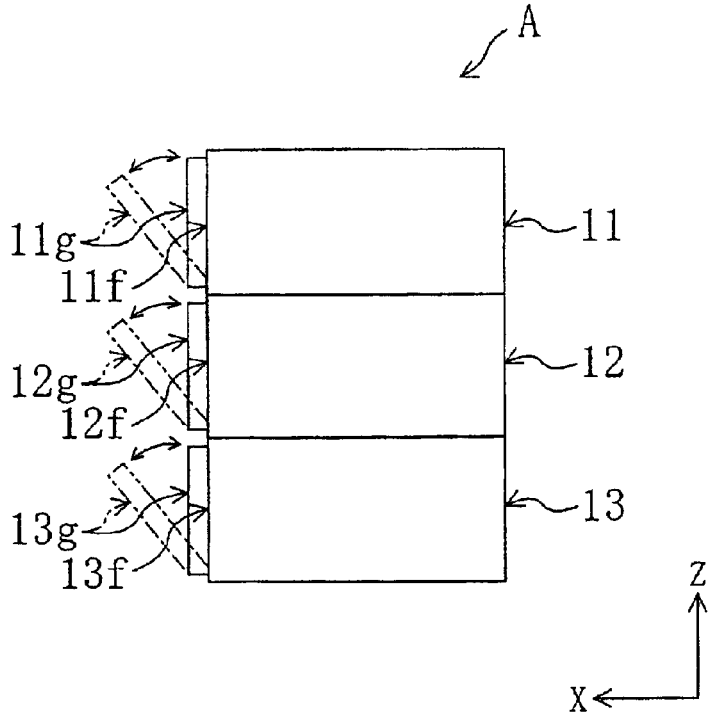
FIG. 11 is a side view showing a recording device provided with access covers for respective recording units.

Referring to FIG. 11, there are formed openings 11*f*–13*f* in sides of the recording units 11–13. The insides of the recording units 11–13 can be accessed through the openings 11*f*–13*f*, respectively. As a result, maintenance work on each of the recording units 11–13, such as the replacement of the main tanks 25*a*–25*d* and the supply of record sheets 4 to each feeding part 3, can be done.

The openings 11*f*–13*f* are provided with access covers 11*g*–13*g*, respectively. The access covers 11*g*–13*g* are pivotably supported at lower end edge portions of the openings 11*f*–13*f*. That is, the access covers 11*g*–13*g* are rotatably configured so that the openings 11*f*–13*f* can be placed in the closed state and in the opened state (see arrows of FIG. 11).

The provision of the openings 11*f*–13*f* in the sides of the recording units 11–13 facilitates the work of maintenance, such as the replacement of the main tanks 25*a*–25*d* and the supply of record sheets 4, on any one of the first to third recording units 11–13 stacked together on top of one another in the Z-direction.

Figure 12:
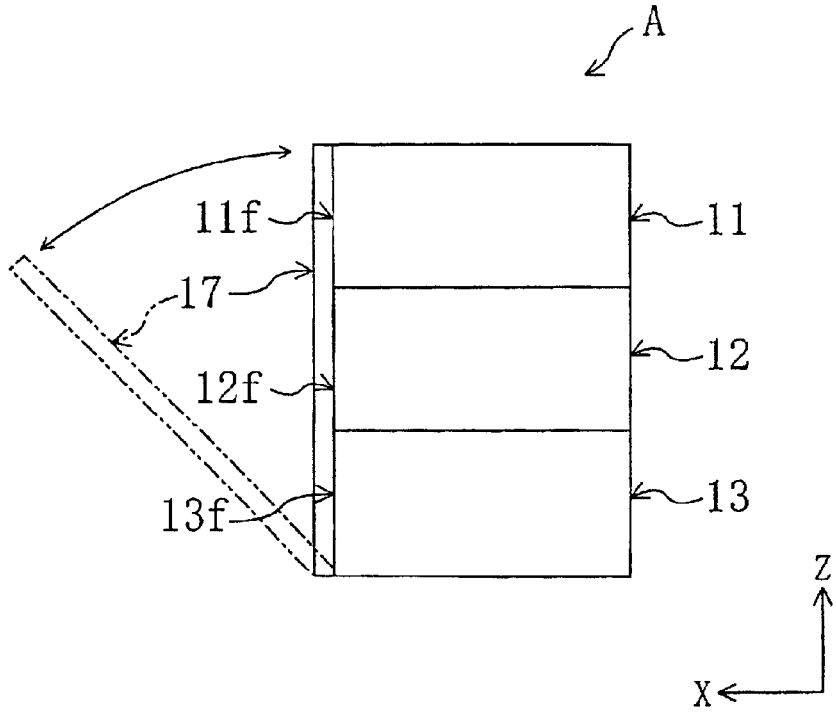
FIG. 12 is a diagram corresponding to FIG. 11, but showing a recording device provided with a single access cover.

Instead of providing the access cover to each of the openings 11*f*–13*f* of the recording units 11–13, a single access cover 17, which extends from the top of the first recording unit 11 to the bottom of the third recording unit 13 in the Z-direction and is capable of opening and closing the openings 11*f*–13*f*, may be provided (see FIG. 12). The access cover 17 is pivotably supported, at its lower end, on a lower end edge portion of the opening 13*f* of the third recording unit 13. Therefore, the access cover 17 is rotatable, and all the openings 11*f*–13*f* can be placed in the closed and opened state by the access cover 17 (see arrows of FIG. 12).

Arrangement for the Operation of Ink Jet Head 21 of Each Recording Unit 11–13

Figure 13:
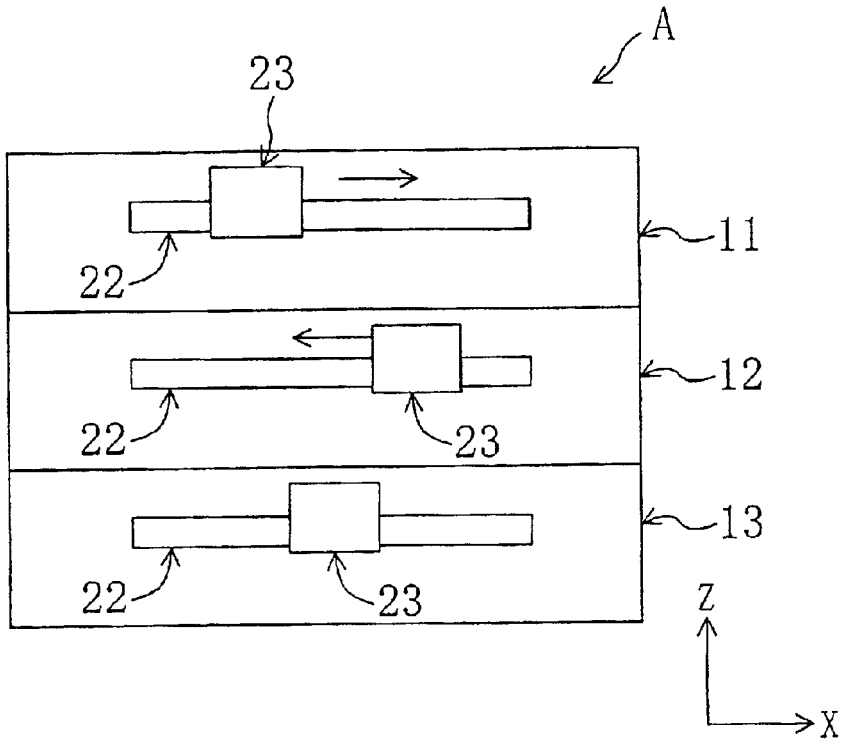
FIG. 13 is a side view illustrating a manner of the carriage reciprocal movement in each recording unit.

As shown in FIG. 13, in the recording device A, the ink jet heads 21 (the carriages 23) of the recording units 11–13 are arranged side by side in the Z-direction. These ink jet heads 21 reciprocate in the same direction (i.e., the X-direction). As a result, the recording device A oscillates by inertial force resulting from the reciprocating motion of the carriage 23. If the three carriages 23 reciprocate in phase, the degree of vibration of the recording device A increases.

To cope with this vibration problem, in the recording device A the carriages 23 of the recording units 11–13 are arranged so as to reciprocate out of phase with respect to each other (see arrows of FIG. 13). This establishes a balance between inertial forces resulting from reciprocating motion of each of the carriages 23, and it is possible to reduce vibration due to the reciprocating motion of the carriages 23.

Further, for example when, of the recording units 11–13, only the first recording unit 11 makes a record of images, only the carriage 23 of the first recording unit 11 reciprocates. In this case, it is impossible to establish an inertial force balance and vibration reduction cannot be achieved. Accordingly, there are some cases in which it is impossible to establish an inertial force balance, depending upon the number of recording units for image recording (i.e., the number of carriages that reciprocate). In accordance with the present embodiment, however, even when an image is recorded only by the first recording unit 11, the carriage 23 of at least one of the second and third recording units 12 and 13 is made to reciprocate, without ink emission (i.e., no image is recorded), out of phase with respect to the reciprocating motion of the carriage 23 of the first recording unit 11. This establishes an inertial force balance, thereby making it possible to reduce vibration due to the reciprocating motion of the carriage 23.

Recording Operations of Recording Device A

A concrete example of the recording of image data ranging over two or more record sheets 4 in the recording device A will be describe below.

Recording the Same Image on Two or More Record Sheets

Figure 14:
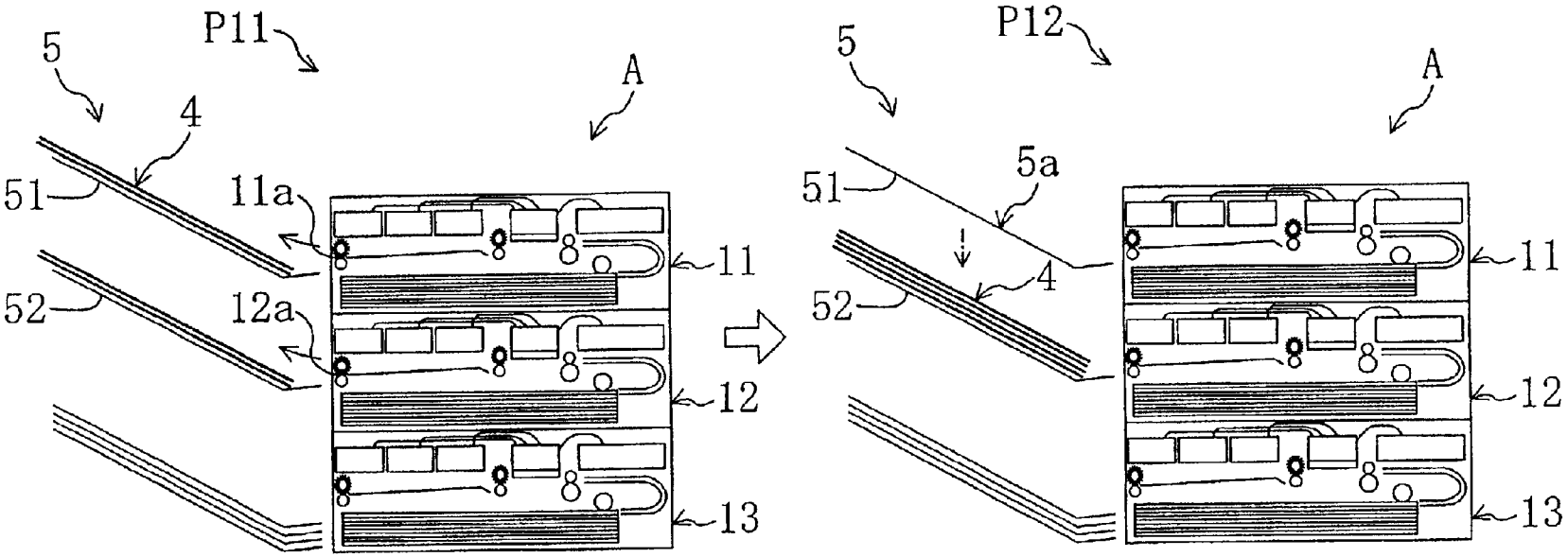
FIG. 14 is an explanatory diagram showing operations of the recording device when recording the same image on two or more record sheets.

When recording the same image on two or more record sheets 4, both the first recording unit 11 and the second recording unit 12 are driven concurrently with each other, whereby the same image can be recorded on different record sheets 4. At this time, in the delivering part 5 the first bin 51 is put in the position of the delivering outlet 11*a* of the first recording unit 11 and the second bin 52 is put in the position of the delivering outlet 12*a* of the second recording unit 12. Both the first bin 51 and the second bin 52 are in the condition ready for the loading of record sheets 4. Then, record sheets 4, which have been image recorded in the first and second recording units 11 and 12, are loaded on the first and second bins 51 and 52 (see P11 of FIG. 14).

In the way described above, when the first and second bins 51 and 52 are each loaded with a preselected number of record sheets 4, the left and right bellows members 73*a* and 73*b* of the first bin 51 are contracted thereby to place the loading surface 71*a* in the contracted state, that is, part of the loading surface 71*a* is opened. This contracted state causes the record sheets 4 placed on the first bin 51 to drop down onto the second bin 52 (see an arrow of long and short dash line of FIG. 14), as a result of which the record sheets 4 are bunched together on the second bin 52 (see P12 of FIG. 14).

In the way described above, two or more recording units of the recording units 11–13 are driven concurrently with each other for the recording of an image on different record sheets 4 so as to share the processing of image data ranging over two or more record sheets 4. Because of this, the time taken to make a record of images is shortened according to the number of recording units that are driven, and the speedup of recording can be achieved. Besides, in comparison with the case of achieving a certain recording rate with a recording device provided with only one recording part, the equal recording rate can be achieved at a lower cost by the present recording device provided with the plural recording units 11–13.

Further, in the delivering part 5, record sheets 4 which have been image recorded in the first recording part 11 and record sheets 4 which have been image recorded in the recording unit 12 are loaded on the first bin 51 and on the second bin 52, respectively, and the record sheets 4 on the first bin 51 are transferred and all the record sheets 4 are finally loaded on the second bin 52. So, a user is required just to fetch the record sheets 4 bunched together on the second bin 52. This therefore offers to users the same use environment as the one when using a single recording device A, thereby providing greatly improved convenience.

When recording the same image on two or more record sheets, an arrangement may be made in which only the first bin 51 is put in the position of the delivering outlet 12*a* of the second recording unit 12 underlying the first recording unit 11 and the record sheets 4 delivered from the first recording unit 11 are dropped downward onto the first bin 51.

Recording Different Images on Two or More Record Sheets (I)

Figure 15:
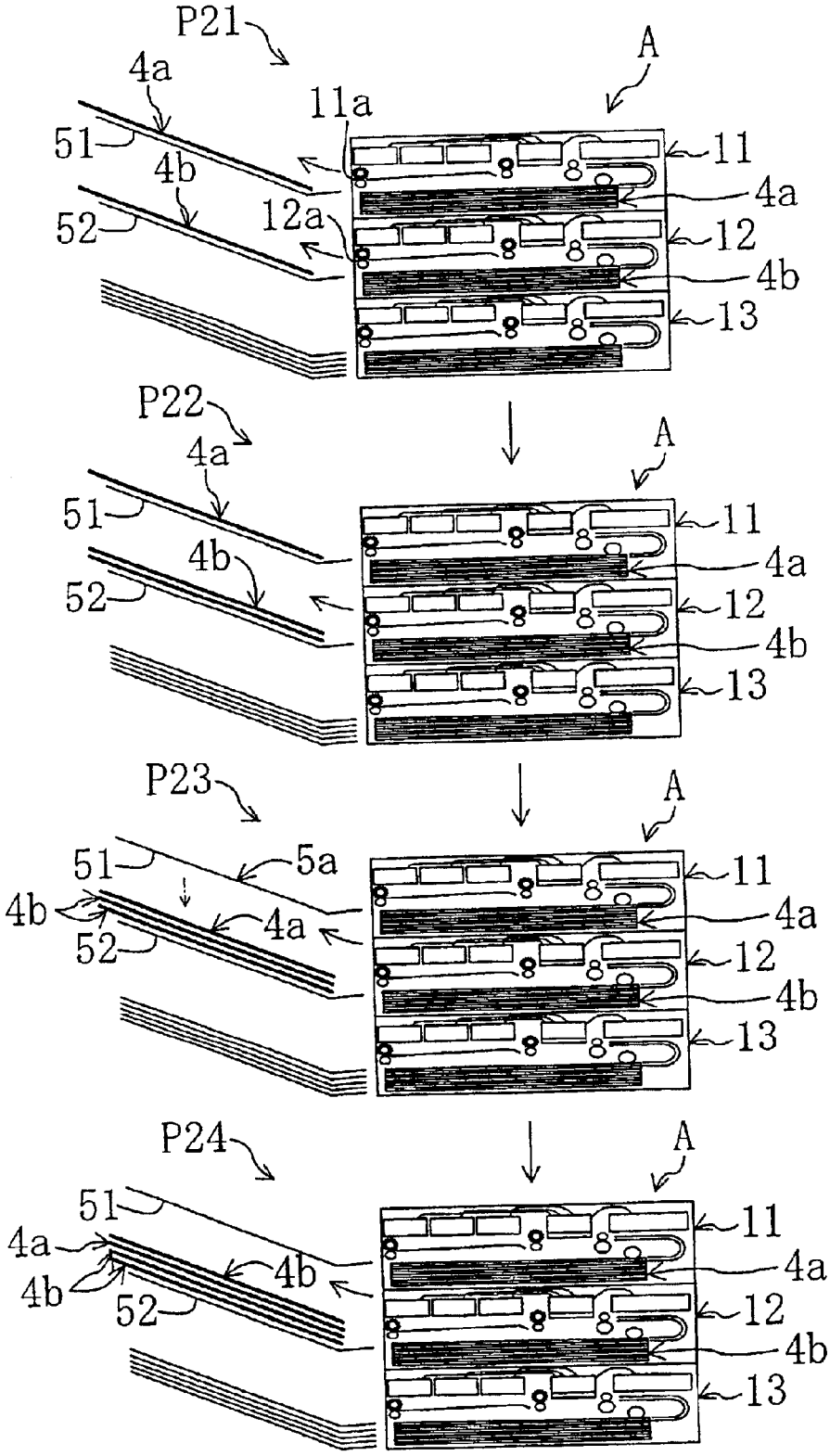
FIG. 15 is an explanatory diagram showing operations of the recording device when recording different images on two or more record sheets (OPERATION 1).

Referring to FIG. 15, an example of the recording of different images on two or more record sheets (more specifically, the preparation of a document composed of a mixture of pages of black-and-white images and pages of color images) will be described below. In FIG. 15, the first and second recording units 11 and 12 contain different types of inks and different types of record sheets (i.e., record sheets 4*a* and record sheets 4*b*). More specifically, the use manner of the first recording unit 11 is made most suitable for the recording of color images, whereas that of the second recording unit 12 is made most suitable for the recording of black-and-white images.

Here, the first recording unit 11 and the second recording unit 12 are driven concurrently with each other. The first recording unit 11 makes a record of color image pages and the second recording unit 11 makes a record of black-and-white image pages, wherein records of images on different record sheets 4 are carried out concurrently. At this time, in the delivering part 5 the first bin 51 is put in the position of the delivering outlet 11*a* of the first recording unit 11 and the second bin 52 is put in the position of the delivering outlet 12*a* of the second recording unit 12. Both the first bin 51 and the second bin 52 are of course placed in the condition ready for the loading of the record sheets 4. The record sheets 4*a* and 4*b*, which have been image recorded in the first and second recording units 11 and 12, are loaded on the first bin 51 and on the second bin 52, respectively (see P21 of FIG. 15).

The second recording unit 12 makes a record of images on a second record sheet 4*b* and delivers it onto the second bin 52 (see P22 of FIG. 15).

Subsequently, the record sheet 4*a* on the first bin 51, as described above, is dropped downward onto the second bin 52 so that the different record sheets 4*a* and 4*b* are stacked on top of one another (see P23 of FIG. 15).

Finally, the second recording unit 12 makes a record of images on a third record sheet 4*b* and delivers it onto the second bin 52, as a result of which the record sheets 4 are bunched together such that the black-and-while image record sheets 4*b* and the color image record sheet 4*a* are stacked on top of one another in a desired sequence (see P24 of FIG. 15).

Two or more recording units of the recording units 11–13 are driven concurrently with each other in the way described above, thereby shortening the time taken to make a record of images. As a result, the speedup of recording can be achieved.

Further, it is possible to form, on the second bin 52, a bunch of record sheets 4 collated in a desired sequence by the first and second bins 51 and 52 and the transferring means 5*a*. Therefore, the user is required just to fetch the bunch of record sheets 4 on the second bin 52, thereby greatly improving the convenience of the recording device A.

Recording Different Images on Two or More Record Sheets (II)

Figure 16:
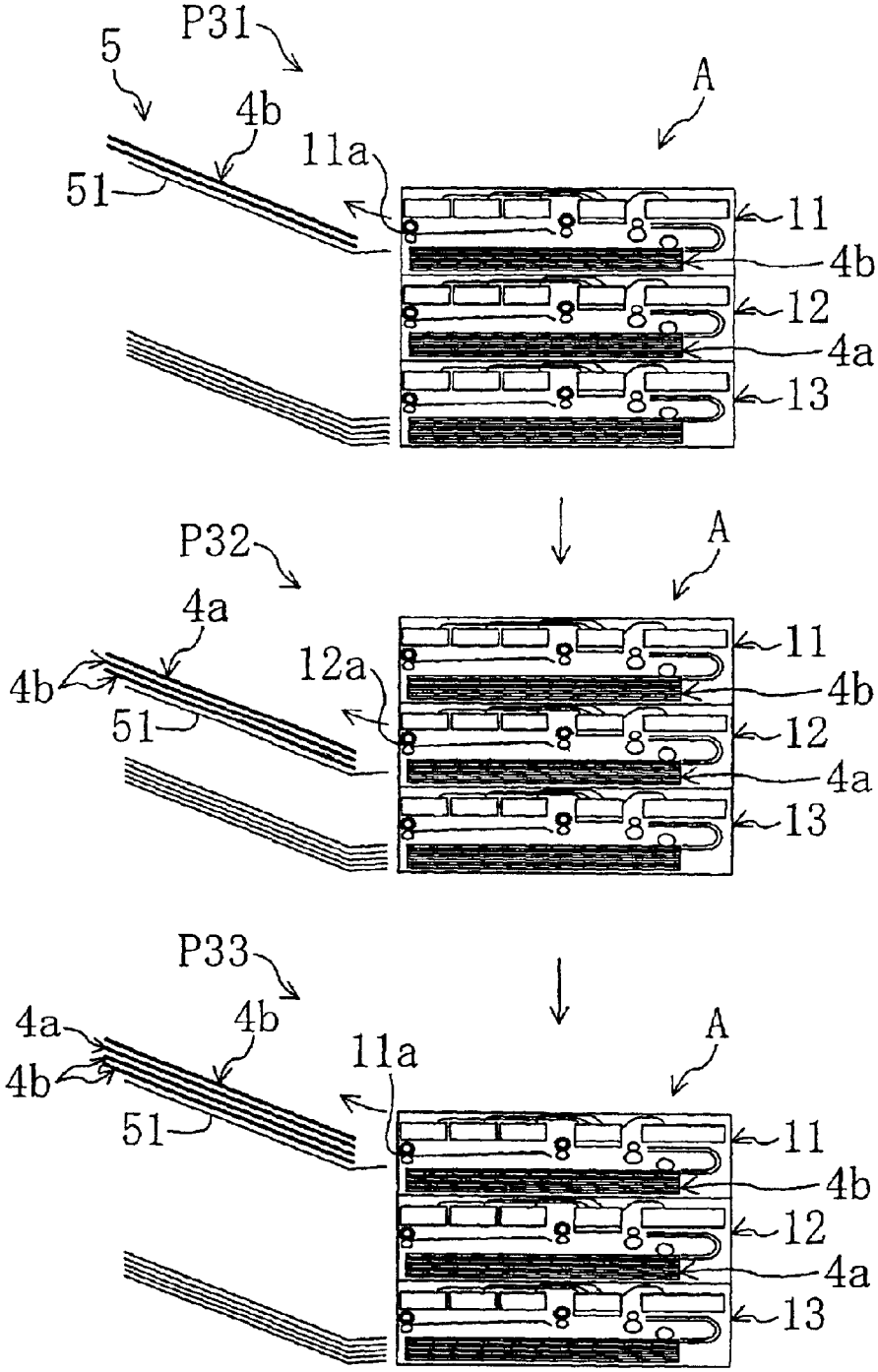
FIG. 16 is an explanatory diagram showing operations of the recording device when recording different images on two or more record sheets (OPERATION 2).

This is a method that does not make utilization of the transferring means 5*a*. The method will be described by making reference to FIG. 16. In FIG. 16, the use manner of the first recording unit 11 is made most suitable for the recording of black-and-white images and the use manner of the second recording unit 12 is made most suitable for the recording of color images.

The first recording unit 11 records images (a record of black-and-white images) on a record sheet 4*b*. Thereafter, the record sheet 4*b* is delivered onto the first bin 51 which has been put in the position of the delivering outlet 11*a* of the first recording unit 11 (see P31 of FIG. 16). During the image recording operation in the first recording unit 11, the second recording unit 12 also records images (a record of color images) on a record sheet 4*a*. Since color image recording is slower than black-and-white image recording, the second recording unit 12 will not have finished color image recording even on a single recording paper 4*a* at the time the first recording unit 11 has already finished black-and-white image recording on two record sheets 4*b*.

Subsequently, in association with the completion of image recording in the second recording unit 12, the first bin 51 is moved and put in the position of the delivering outlet 12*a* of the second recording unit 12. Then, the second recording unit 12 delivers the image-recorded record sheet 4*a* onto the first bin 51 (see P32 of FIG. 16).

Thereafter, the first bin 51 is moved and put again in the position of the delivering outlet 11*a* of the first recording unit 11, and the first recording unit 11 delivers the image-recorded record sheets 4*b* onto the first bin 51 (see P33 of FIG. 16). The timing, at which the first recording unit 11 starts image recording on a third record sheet 4*b*, may be adjusted according to the progress of image recording in the second recording unit 12.

In the way describes above, a bunch of record sheets 4*a* and 4*b* stacked together on top of one another in a desired sequence is formed on the first bin 51, just by causing the first bin 51 to move in association with the time at which the first and second recording units 11 and 12 complete their image recording.

This is effective, especially when there is a great difference in the rate of image recording between the first and second recording units 11 and 12. Also in this case, the total rate of image recording in the recording device A will not be reduced.

Preparing Two Sets of a Document of Record Sheets of Different Images

Figure 17:
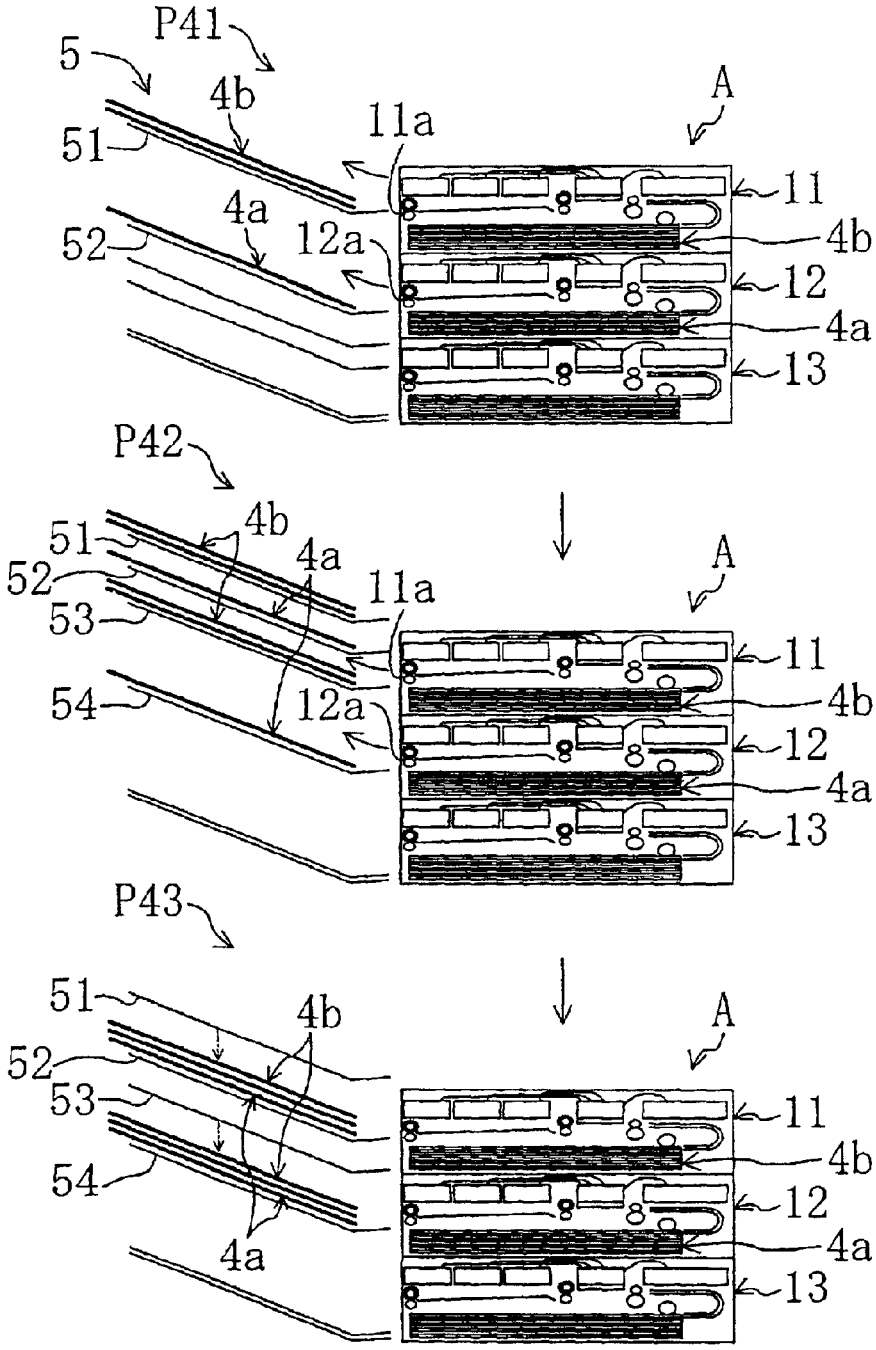
FIG. 17 is an explanatory diagram showing operations of the recording device when preparing two sets of a document composed of two or more record sheets of different images.

An example of preparing two sets of a document that is composed of two or more record sheets of different images, e.g., a record of two sets of a document that is composed of a mixture of white-and-black and color image pages, will be described with reference to FIG. 17. In FIG. 17, the use manner of the first recording unit 11 is made most suitable for white-and-black image recording and the use manner of the second recording unit 12 is made most suitable for color image recording.

In the first place, the first recording unit 11 is driven concurrently with the second recording unit 12 so that recording operations on different record sheets 4*a* and 4*b* are carried out concurrently. At this time, in the delivering part 5 the first bin 51 is put in the position of the delivering outlet 11*a* of the first recording unit 11 and the second bin 52 is put in the position of the delivering outlet 12*a* of the second recording unit 12. As a result, the record sheets 4*a* and 4*b*, which have been image recorded in the first and second recording units 11 and 12, are loaded on the first bin 51 and on the second bin 52, respectively (see P41 of FIG. 17).

Subsequently, both the first bin 51 and the second bin 52 are moved upward to their withdrawal positions, and the third bin 53 is put in the position of the delivering outlet 11*a* of the first recording unit 11 and the fourth bin 54 is put in the position of the delivering outlet 12*a*of the second recording unit 12. And, like the above, the first recording unit 11 and the second recording unit 12 are driven concurrently with each other, and recording operations on record sheets 4*a* and 4*b* are carried out concurrently. The record sheets 4*a* and 4*b*, which have been image recorded in the first and second recording units 11 and 12, are loaded on the third bin 53 and on the fourth bin 54, respectively (see P42 of FIG. 17).

Thereafter, the record sheet 4*a* on the first bin 51 is dropped down onto the second bin 52 by the transferring means 5*a*, while on the other hand the record sheet 4*a* on the third bin 53 is dropped down onto the fourth bin 54 by the transferring means 5*a*. As a result, the record sheets 4 (i.e., the white-and-black and color image record sheets 4*b* and 4*a*) are bunched and stacked together on top of one another in a desired sequence on the second and fourth bins 52 and 54. Because of this, the user is required just to fetch these record sheet bunches from the second and fourth bins 52 and 54.

Two or more recording units of the recording units 11–13 are driven concurrently with each other in the way described above, thereby making it possible to reduce the time taken to make a record of images. The speedup of image recording can be achieved. Additionally, it is possible to facilitate the preparation of two sets of a document composed of two or more record sheets of different images. As a result, the convenience of the recording device A can be improved greatly.

When shortening the time taken to make a record of images by concurrent driving of two or more recording units of the recording units 11–13, the recording method of the recording part 2 is not limited to the ink jet method. Any other method may be employed as long as it is able to make a record of images on the record medium (the record sheet 4).

Figure 18:
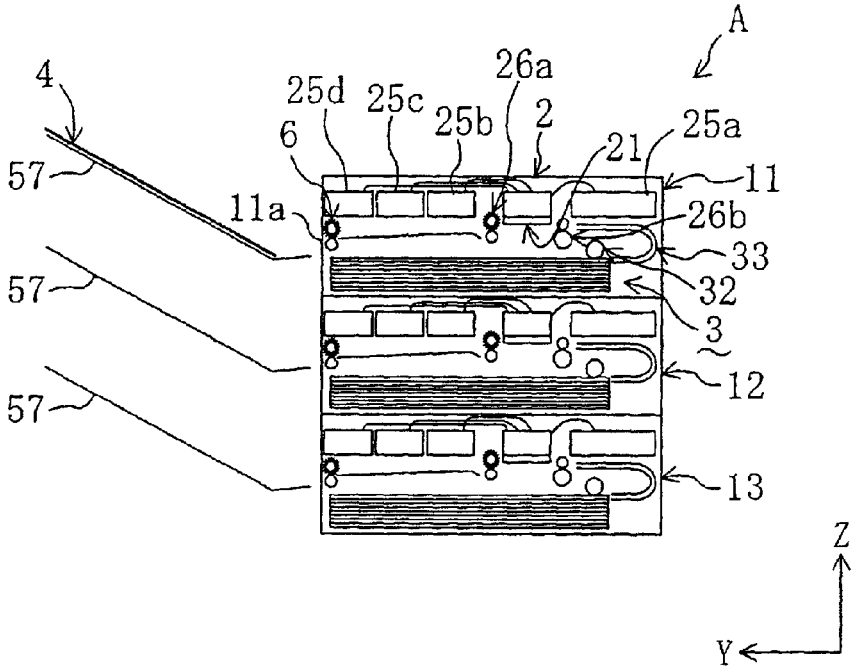
FIG. 18 is a diagram corresponding to FIG. 1, but showing a recording device provided with bins for respective recording units.

Further, in the aforesaid "Recording the Same Image on Two or More Record Sheets" and "Recording Different Images on Two or More Record Sheets (I)", the delivering part 5 may not be composed of the first to sixth bins 51–56 individually movable in the Z-direction by the elevating means. For example, as shown in FIG. 18, it may be arranged such that each of the recording units 11–13 is provided with a respective bin 57.

Other Embodiments of the Bin

Next, other arrangements for transferring a record sheet 4 between each bin will be described by making reference to FIGS. 19 and 21.

Arrangement 1

Figure 19:
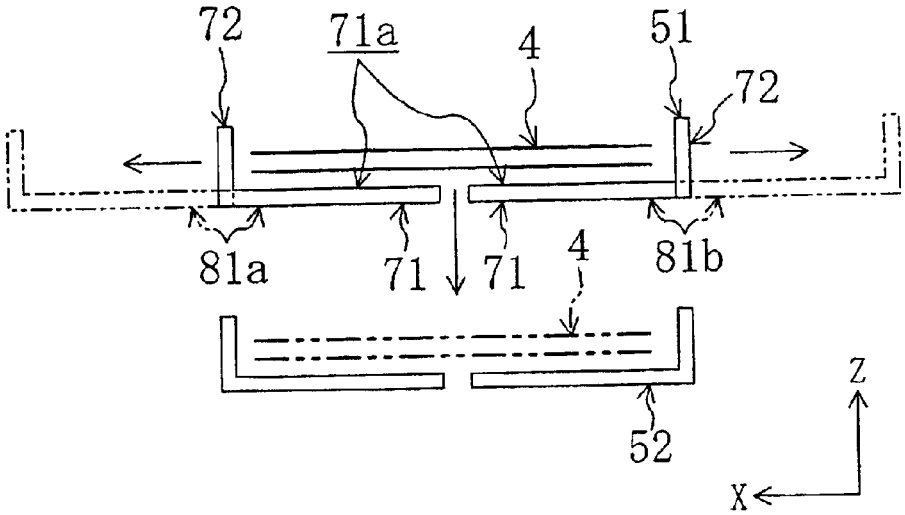
FIG. 19 is a schematic diagram showing another arrangement of a transferring means.

Referring to FIG. 19, there are shown certain of the bins 51–56 (the first and second bins 51 and 52 in the figure). Each of the bins 51–56 comprises a pair of first and second wall members 81*a* and 81*b* having an approximately L-shaped cross section. The first wall member 81*a* comprises one of the regulating vertical walls 72 of the first bin 51 and approximately an X-direction first half of the loading bottom wall 71. The second wall member 81*b* comprises the other regulating vertical wall 72 and approximately the X-direction other half of the loading bottom wall 71. Lying face to face with each other, the first and second wall members 81*a* and 8*b* together form the single bin 51 shaped like the tray.

These first and second wall members 81*a* and 8*b* are configured movably in the X-direction so that they can be switchable between a proximity state in which the wall members 81*a* and 81*b* are brought into close proximity to each other to form the loading surface of the first bin 51 and a clearance state in which the wall members 81*a* and 81*b* are moved away from each other so as to allow a record medium to drop down (see an arrow of FIG. 19). It is arranged such that, when the first and second wall members 81*a* and 81*b* are placed in the clearance state, the record sheet 4 loaded on the loading surface 71*a* of the first bin 51 will drop downward onto the second bin 52.

Arrangement 2

Figure 20:
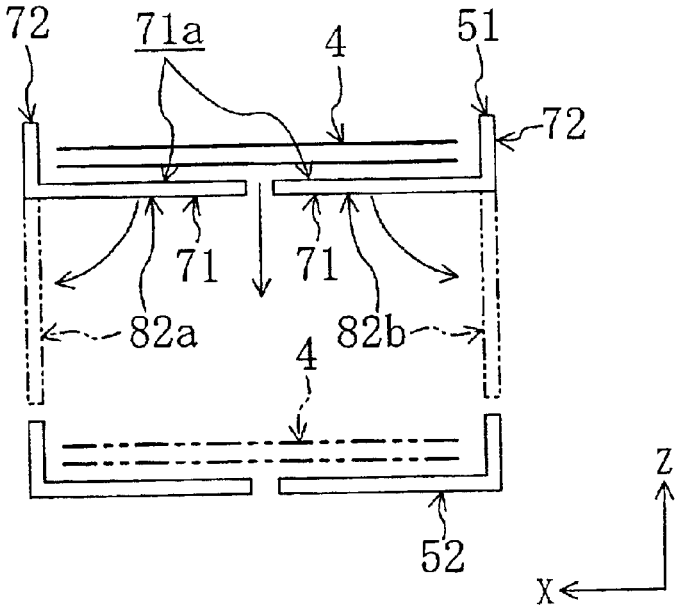
FIG. 20 is a schematic diagram showing still another arrangement of the transferring means.

Referring to FIG. 20, there are shown certain of the bins 51–56 (the first and second bins 51 and 52 in the figure). Each of the bins 51–56 comprises a pair of first and second wall members 82*a* and 82*b* having an approximately L-shaped cross section. The first wall member 82*a* comprises one of the regulating vertical walls 72 and approximately an X-direction first half of the loading bottom wall 71 and the second wall member 82*b* comprises the other regulating vertical wall 72 and approximately the other half of the loading bottom wall 71. Plate-like portions of the first and second wall members 82*a* and 82*b* that together form the loading bottom wall 71 are pivotally supported on the lower ends of portions forming the regulating vertical walls 72 (the side ends of the first bin 51), respectively. The plate-like portions are rotatably configured so that they can switch between a state in which the loading surface 71*a* of the first bin 51 is formed and another state in which the loading surface 71*a* is opened permitting the record sheet 4 to drop down (see an arrow of FIG. 20). Because of such arrangement, when the portions forming the loading bottom wall 71 in the first and second wall members 82*a* and 82*b* are rotated so as to place the loading surface 71*a* in the opened state, the record sheet 4 loaded on the first bin 51 is dropped down onto the second bin 52.

Figure 21:
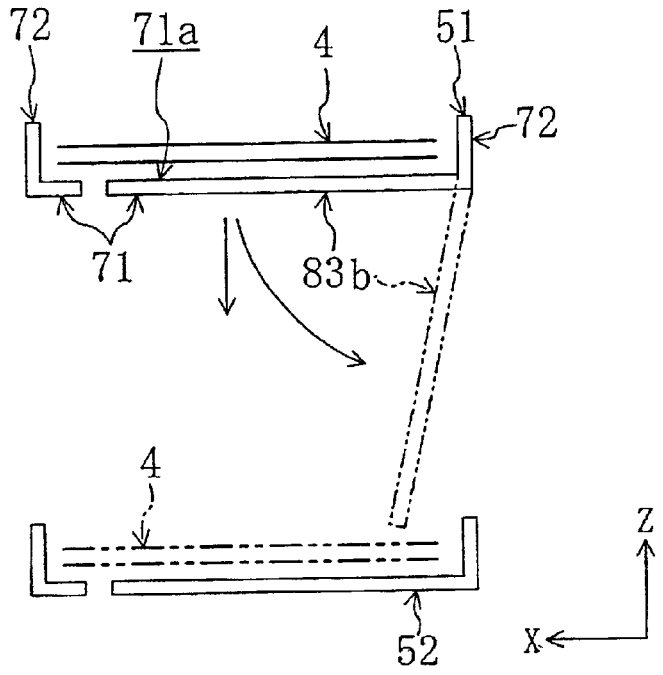
FIG. 21 is a schematic diagram showing a further arrangement of the transferring means.

Each bin may be configured as shown in FIG. 21. That is, the shape of the paired first and second wall members may be modified. More specifically, the portion of a second member 83*b* forming the loading bottom wall 71 is formed so as to extend in the X-direction to near the regulating vertical wall 72 on the X-direction left side. This portion is pivotally supported on the lower end of a portion forming the X-direction right side regulating vertical wall 72 (one side end of the first bin 51). The portion forming the loading bottom wall 71 in the second member 83*b* is configured rotatably so that it can switch between a state in which the loading surface 71*a* of the first bin 51 is formed and another state in which the loading surface 71*a* is opened permitting the record sheet 4 to drop down (see an arrow of FIG. 21). Also in this case, when the portion forming the loading bottom wall 71 in the second member 83*b* is rotated, the record sheet 4 loaded on the loading surface 71*a* of the first bin drops downward onto the second bin 52.

Conversely, an alternative arrangement (not shown) may be made in which a bottom wall member (a wall member) in the first member is so formed as to extend in the X-direction to near the regulating vertical wall 72 on the X-direction right side and a plate-like portion (a wall member) forming the loading bottom wall 71 in the first member is pivotably supported on the lower end (one side end of the first bin 51) of a portion forming the regulating vertical wall 72 on the X-direction right side.

Other Embodiments of the Ink Tank

Figure 22:
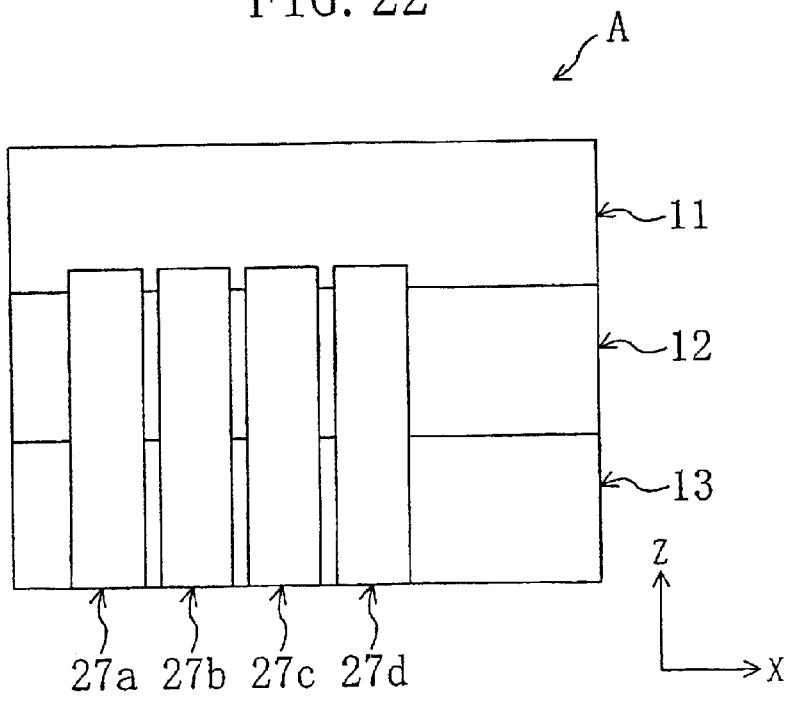
FIG. 22 is a side view showing a recording device provided with a main tank in common between each recording unit.
Figure 23:
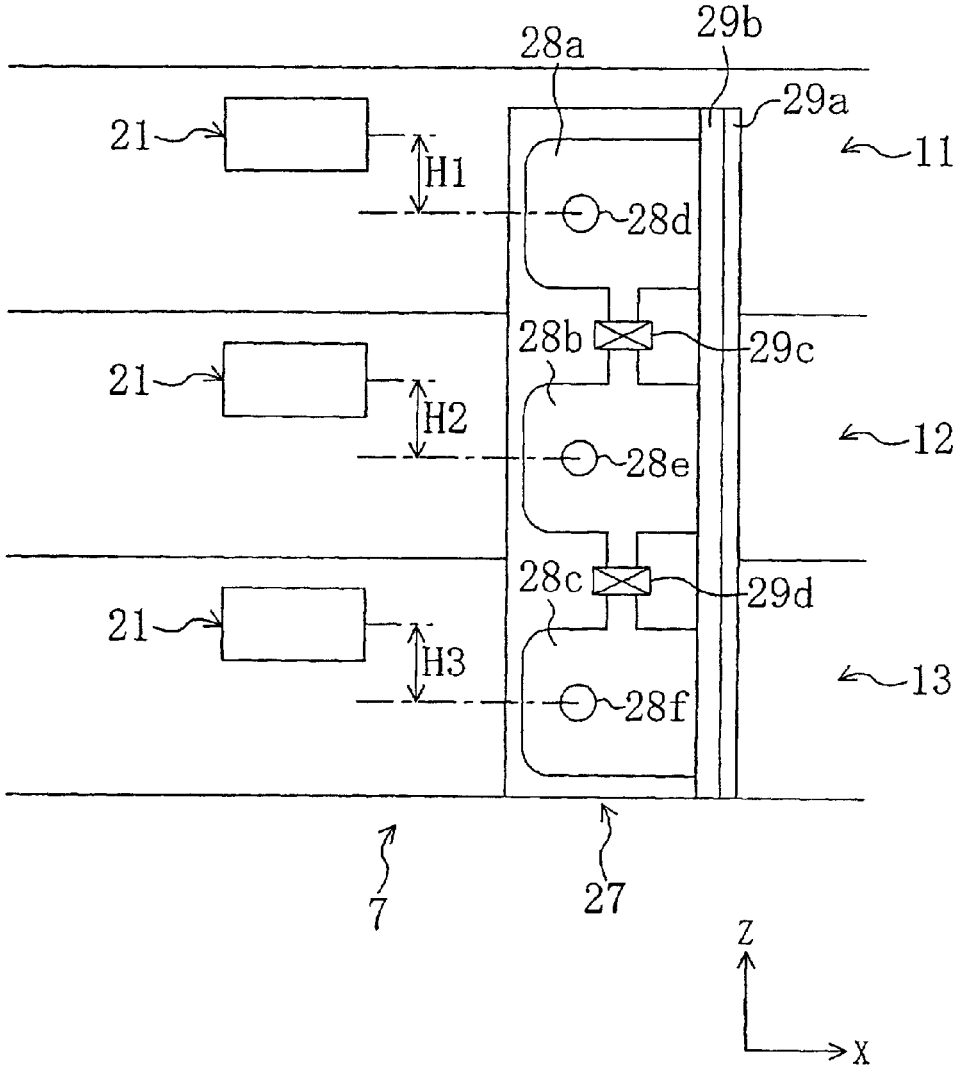
FIG. 23 is a side view enlargedly showing an arrangement of the main tank.

Referring to FIGS. 22 and 23, another arrangement of the ink tanks will be described. In accordance with this arrangement, instead of the provision of the main ink tanks 25*a*–25*d* for each recording unit 11–13, a single set of main ink tanks 27 (27*a*–27*d*) common to each recording unit 11–13 is provided. Since other arrangements of the recording device A are the same as the foregoing embodiment, the same members have been assigned identical reference numerals and the description thereof is omitted.

The main ink tanks 27 are provided individually for each color and disposed on the side of the recording units 11–13 and each main ink tank 27*a*–27*d* holding a respective color is connected to its corresponding sub tank 24*a*–24*d*positioned in the carriage 23 of the recording part 2 through an individual supplying tube provided for each recording unit 11–13.

As shown in FIG. 23, each main ink tank 27 is disposed extending in the Z-direction such that its upper end lies in the position of the first recording unit 11 and its lower end lies in the position of the third recording unit 13. Further, each main tank 27 is divided in the Z-direction into three ink chambers 28*a*–28*c* corresponding to the first to third recording units 11–13, respectively.

Each of the ink chambers 28*a*–28*c* has flexibility. Of these three ink chambers 28*a*–28*c*, pairs of two adjacent ink chambers, i.e., the ink chambers 28*a* and 28*b* and the ink chambers 28*b* and 28*c*, are communicated with each other through switch valves 29*c* and 29*d*, respectively.

Formed in the ink chambers 28*a*–28*c* are mounting holes 28*d*–28*f* to which the supplying tubes are connected. These three mounting holes 28*d*–28*f* are spaced from each other in the Z-direction at given equal intervals. As a result of such spacing, vertical distances H1–H3 between the ink jet heads 21 of the recording units 11–13 and their corresponding mounting holes 28*d*–28*f* are set approximately the same.

Further, a movable wall portion 29*a* shaped like the plate is disposed in abutment with each of the ink chambers 28*a*–28*c*through an elastic member 29*b* capable of elastic deformation on the side of the ink chambers 28*a*–28*c*. The movable wall portion 29*a* is configured so that it can move toward the ink chambers 28*a*–28*c* (see an arrow of the figure).

Next, the opening/closing control of the switch valves 29*c* and 29*d* will be described. Both of these two switch valves 29*c* and 29*d* are placed in the closed state during the ink emission in each ink jet head 21. As a result, each ink chamber 28*a*–28*c* becomes independent of every other ink chamber, so that ink suction pressures (produced during the ink emission) in the ink jet heads 21 of the recording units 11–13 are approximately equalized. This therefore smoothens the supply of ink to the ink jet heads 21 and the drop in image recording accuracy in each recording unit 11–13 can be avoided. That is, an adjusting means 7 for performing adjustment so that the ink jet heads 21 are approximately equalized in ink suction pressure is composed of the mounting holes 28*d*–28*f* for the supplying tubes formed in the ink chambers 28*a*–28*c*, respectively, and the switch valves 29*c* and 29*d* both of which are placed in the closed state during the ink emission.

Further, during the ink emission each ink chamber 28*a*–28*c* becomes independent of every other ink chamber, which may result in causing the amount of ink held in a certain one of the ink chambers 28*a*–28*c* to decrease in comparison with the other ink chambers. In this case the elastic member 29*b* undergoes elastic deformation, and the volume of each of the ink chambers 28*a*–28*c* decreases according to the reduction of ink. This makes it possible to prevent the buildup of a negative pressure (which is a pressure with respect to the direction in which ink flows from the sub tanks 24*a*–24*d* to the ink tank 27). Further, the provision of the elastic member 29*b* may be omitted as long as, even when a negative pressure builds up in each ink chamber 28*a*–28*c*, such a negative pressure buildup state can be canceled by pressure reduction by a corresponding one of the sub tanks 24*a*–24*d*.

The opening/closing of the switch valves 29*c* and 29*d* is controlled such that, when the ink jet head 21 emits no ink, these two switch valves 29*c* and 29*d* are not placed in the opened state at the same time. This causes the ink chamber 28*b* to communicate with the ink chambers 28*a* and 28*c* at different timings, thereby providing approximately the same condition as the condition in which a single ink tank is formed. Further, during the time in which no ink is emitted the movable wall portion 29*a* moves according to the amount of ink held in each ink chamber 28*a*–28*c*, to reduce the volume of each ink chamber 28*a*–28*c*. This ensures that ink is supplied from each ink chamber 28*a*–28*c* to the sub tanks 24*a*–24*d*. In addition to this, all the ink held in each ink chamber 28*a*–28*c* can be supplied to the sub tanks 24*a*–24*d*.

If the two switch valves 29*c* and 29*d* are placed in the opened state at the same time, this may result in ink leakage from the ink jet head 21. That is, the ink tank 27 is composed of two or more ink chambers (the ink chambers 28*a*–28*c*) defined side by side in the Z-direction. So, if the two switch valves 29*c* and 29*d* are simultaneously placed in the opened state, this increases the pressure at the mounting hole 28*f* formed in the lowermost ink chamber 28*c* (the pressure with respect to the direction in which ink flows from the ink tank 27 to the sub tanks 24*a*–24*d*). Because of this, there is a possibility that ink leaks from the ink jet head 21. To cope with such ink leakage, the opening/closing control of the two switch valves 29*c* and 29*d* is performed such that they are not placed in the opened state at the same time, whereby the increase in pressure within the lowermost ink chamber 28*c* can be controlled. As a result, it becomes possible to avoid the leakage of ink from the ink jet head 21.

Modification

Figure 24:
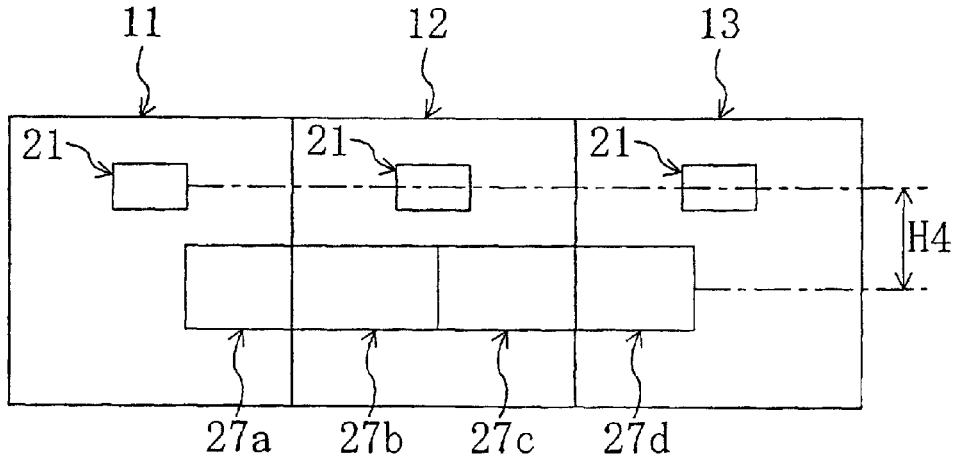
FIG. 24 is a side view showing a recording device provided with an array of recording units horizontally arranged.

In the foregoing embodiment the first to third recording units 11–13 are stacked together on top of one another in the Z-direction. Therefore, the ink jet heads 21 of the recording units 11–13 differ from one another in height position with respect to the main tank 27. On the other hand, if the recording units 11–13 are horizontally disposed side by side as shown in FIG. 24, vertical distances, H4, between each of the ink jet heads 21 of the recording units 11–13 and the main tank 27 can be set the same. As a result of such arrangement, ink suction pressures in the ink jet heads 21 of the recording units 11–13 can approximately be equalized without the provision of the adjusting means 7. As a result, the drop in image recording accuracy in each recording unit 11–13 can be avoided.

Embodiment When Delivering Part 5 Serves as a Sorter

When the delivering part 5 has two or more bins (the bins 51–56), the delivering part 5 is able to function as a sorter 5 capable of sorting record sheets 4 by set or by page. Further, the delivering part 5 is able to function also as a sorter 5 capable of sorting record sheets 4 by image data output case.

When the delivering part 5 is made to function as a sorter, the following operations can be carried out because record sheets 4 can be transferred between each bin of the delivering part 5.

Next, the operation of the delivering part 5 serving as a sorter 5 capable of sorting record sheets 4 by image data output case will be described.

When the delivering part 5 functions as a sorter, the recording device A operates in the second mode in which each of the recording units 11–13 performs the processing of image data independently of the other recording units. This is the same configuration as that of a recording device with a single recording unit. Here, for the sake of easy understanding, the operation of a recording device P having a single recording unit 11 will be described as an example (see FIG. 25).

Figure 25:
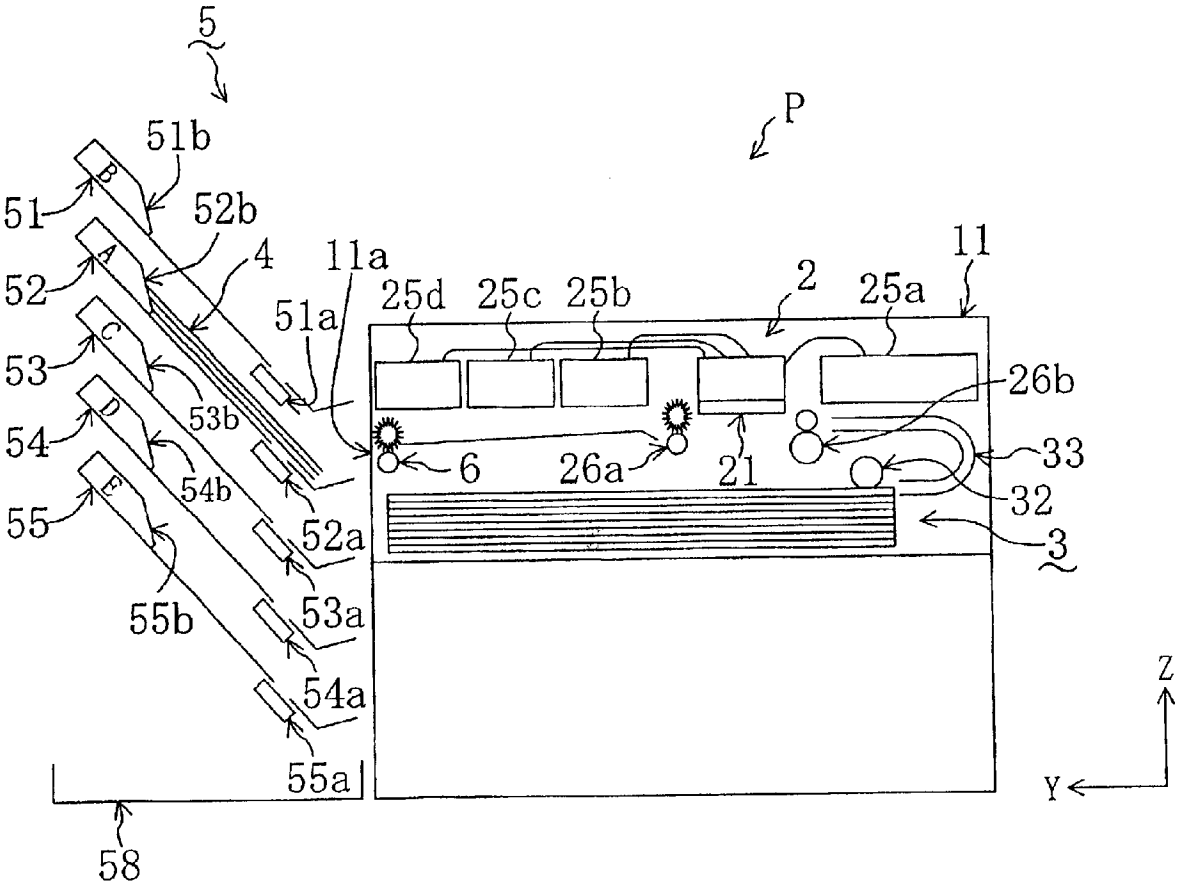
FIG. 25 is a diagram corresponding to FIG. 1, but showing an arrangement of a recording device provided with a single recording unit.

Referring to FIG. 25, the recording device P is provided with a recording unit 2 and a feeding part 3 for supplying record sheets 4 to the recording unit 2. The sorter 5 is provided with two or more bins (five bins, namely first to fifth bins 51–55 in the figure) each having an upward loading surface 71*a* (see FIGS. 3–6) onto which a record sheet 4, image recorded in the recording part 2 and delivered from a delivering outlet 2*a*, is loaded. The sorter 5 is configured such that it sorts record sheets 4 by page, by set, or by image data output case by loading the record sheets 4 on the loading surfaces 71*a* of the different bins 51–55. In the recording device P, components corresponding to those of the recording device A have been assigned the same reference numeral and they are not described here in detail accordingly.

The sorter 5 is disposed as follows. That is, the first to fifth bins 51–55 are arranged in the Z-direction in that order in the top-to-bottom direction, being spaced from each other at specific intervals in the Z-direction. The bins 51–55 are configured so that they can be moved in the Z-direction by an elevating means (not shown). Because of this, when sorting record sheets 4 by page or by set, the first to fifth bins 51–55 are put in the position of the delivering outlet 11*a* by turns, in association with the time of completion of the recording of an image on a record sheet 4 in the recording part 2. Because of this, image-recorded record sheets 4 delivered from the delivering outlet 11*a* are loaded on the different bins 51–55 by page or set so as to sort the record sheets 4.

When only the sorting of record sheets 4 is required, an arrangement may be made in which for example individual paper delivering paths extending from the delivering outlet 11*a* to each bin 51–55 are provided instead of employing the arrangement that record sheets 4 are sorted out by movement of each bin 51–55. This allows record sheets 4 which have been image recorded in the recording part 2 to be loaded on each bin 51–55 through the different paper delivering paths by page or set, thereby making it possible to sort the record sheets 4.

Further, as shown in FIG. 25, the first to fifth bins 51–55 are provided with detecting means 51*a*–55*a*, respectively. The detecting means 51*a*–55*a* detect whether their corresponding bins 51–55 are loaded with the record sheet 4.

Additionally, the bins 51–55 are provided with displaying parts 51*b*–55*b* (displaying means), respectively. Each of the displaying parts 51*b*–55*b* is able to display sings "A"–"E". These signs "A"–"E" each serves as an indication allowing a user who has output image data to the recording device P to specify a bin of the bins 51–55 that has been loaded with a record sheet 4 carrying an image according to the image data. The user who has output the image data is notified of either one of the signs. From the notified sign and its corresponding sign displayed on any one of the displaying parts 51*b*–55*b*, the user can tell which one of the bins 51–55 is loaded with a record sheet 4 relating to the image data output by the user. That is, when a user is informed of for example the sign of "A", the user can tell that a target record sheet 4 has been loaded on a bin (51–55) whose display part (51*b*–55*b*) is now displaying the sign of "A". This therefore allows the user to easily identify the record sheet 4 relating to the image data output by the user.

Further, when the record sheet 4 loaded is transferred between the bins 51–55, each of the displaying parts 51*b*–55*b* changes its display contents in association with such a sheet transfer, as will be described later. For example, when the record sheet 4 on the first bin 51 whose displaying part 51*b* is displaying the sign "A"is transferred onto the second bin 52, it is arranged such that, while causing the displaying part 52*a* of the second bin 52 to display the sign "A", the displaying part 51*b* of the first bin 51 is made to display other than the sign "A", i.e., either one of the signs "B"–"E".

Further, positioned under the lowermost bin with respect to the Z-direction (i.e., the fifth bin 55) is a storing part 58 for storing image-recorded record sheets 4. The storing part 58 may not be provided, in which case the fifth bin 55 is made to serve also as a storing part.

The configuration of the bins 51–55 is the same as the one shown in FIGS. 3–6 and will not be described here. That is, each bin 51–55 is provided with a transferring means 5*a* by which the record sheet 4 loaded on its loading surface 71*a* is dropped down onto its directly underlying bin (51–55), as a result of which the record sheet 4 is transferred.

Next, the operation of the sorter 5 will be described. The sorter 5 is so configured as to sort record sheets 4 by page or set and to sort record sheets 4 by output case. When sorting the record sheets 4 by page or set, the first to fifth bins 51–55 are put in the position of the delivering outlet 11*a* of the recording part 2 by turns so that image-recorded record sheets 4 delivered from the delivering outlet 2*a* are loaded on the different bins 51–55 by page or by set.

On the other hand, when sorting the record sheets 4 by output case, record sheets 4 that are newly output are always loaded on the first bin 51. The record sheets 4 are loaded on each bin (the order is from the first bin 51 to the fifth bin 55) in most-to-least-recent order by output case.

That is, when a user inputs image data to the recording device P, the recording part 2 makes a record of images on the record sheet 4 according to the image data. Together with this, in the sorter 5 the first bin 51 is put in the position of the delivering outlet 11*a* and the record sheet 4 delivered from the recording part 2 is loaded on the loading surface 71*a* of the bin 51. Because of this, the record sheets 4 are bunched together on the first bin 51. At this time, the user who has output the image data is notified of the sign "A" and the displaying part 51*b* of the first bin 51 displays the sign "A".

When new image data is input to the recording device P, the detecting means 51*a* of the first bin 51 detects whether a record sheet 4 is loaded on the first bin 51. If the detecting means 51*a* detects that no record sheet 4 is loaded on the first bin 51 (the user already fetched the record sheet 4), the first bin 51 is put in the position of the delivering outlet 11*a* so that a record sheet 4 delivered from the recording part 2 is loaded on the loading surface 71*a* of the first bin 51.

On the other hand, if the detecting means 51*a* detects that there is a record sheet 4 on the first bin 51 (the user has not yet fetched the record sheet 4), the record sheet 4 on the first bin 51 is dropped down by the transferring means 5*a* onto the second bin 52. As a result of such a sheet transfer, the first bin 51 becomes empty (there is no record sheet 4 on the first bin 51). At this time, the displaying part 52*a* of the second bin 52 displays the sign "A", whereas the displaying part 51*a* of the first bin 51 displays for example the sign "B"(see FIG. 1). Then, the recording part 2 makes a record of images on a record sheet 4 according to the new image data and delivers the image-recorded record sheet 4 onto the first bin 51. In this way, the record sheet 4, on which the new image data has been recorded, is loaded on the first bin 51. Together with this, the record sheet 4 delivered prior to the record sheet 4 on the first bin 51 is loaded on the second bin 52 underlying the first bin 51.

Further, if record sheets 4 are already loaded on both the first and second bins 51 and 52 at the time when new image data is input to the recording device P, the record sheet 4 on the second bin 52 is transferred onto the third bin 53 and the record sheet 4 on the first bin 51 is transferred onto the second bin 52. In this way, the first bin 51 is placed in the empty state and a record sheet 4, which have been image recorded in the recording part 2, is loaded on the first bin 51.

Further, if new image data is input to the recording device P when all the first to fifth bins 51–55 are loaded with record sheets 4, the record sheet 4 on the fifth bin 55 is transferred by the transferring means 5*a* to the storing part 58 positioned under the fifth bin 55. Then, the record sheets 4 loaded on the first to fourth bins 51–54 are transferred downwardly to their respective lower bins 52–55, as a result of which the first bin 51 is emptied. In this way, the first bin 51 is always placed in the empty state and newly-delivered record sheets 4 are loaded on the first bin 51.

In the way as described above, new record sheets 4 can be always delivered onto the first bin 51, as a result of which arrangement the delivering of a record sheet 4 onto a bin that has already been loaded with another record sheet 4 is prevented. This makes it possible to improve the convenience of the recording device at the time of use thereof. Besides, the record sheets 4 are delivered onto the uppermost bin (the first bin 51) that is a bin from which the user can most easily fetch the record sheets 4, thereby further improving the convenience of the recording device at the time of use thereof.

Further, when a record sheet 4 is transferred between the bins 51–55, each of the displaying parts 51*a*–55*a* of the bins 51–55 changes its display contents in association with the transfer of the record sheet 4. Because of this, a user can easily identify a bin on which the record sheet 4 relating to the image data output by the user has been loaded, just by looking at an indication displayed on a corresponding one of the displaying means 51*a*–55*a*.

Other Embodiments of the Sorter

Figure 26:
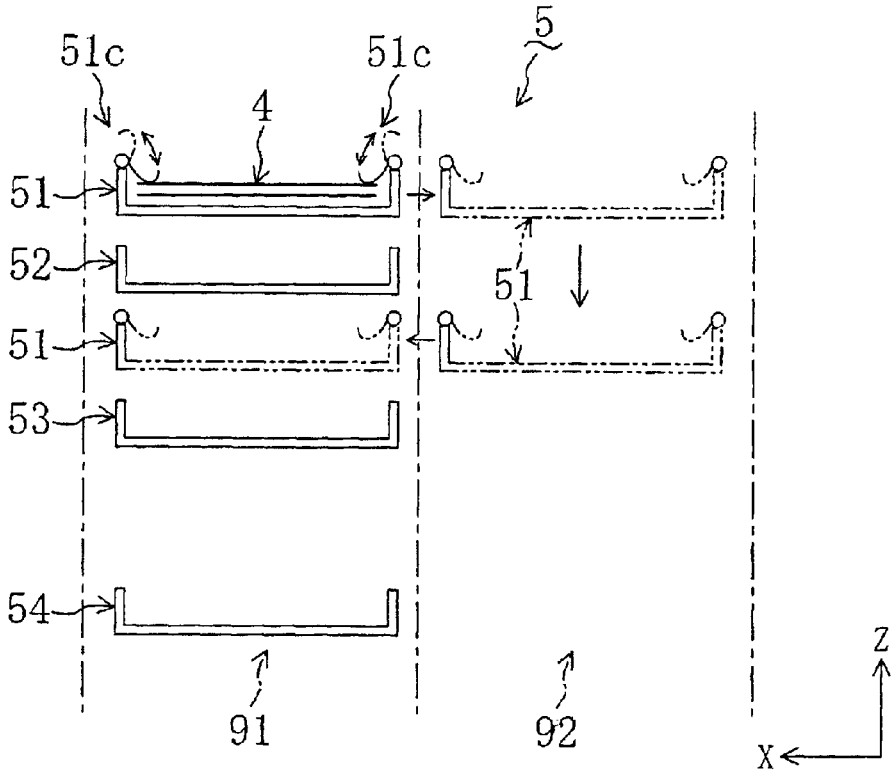
FIG. 26 is a schematic diagram showing another arrangement of a sorter.

Referring to FIG. 26, there is shown a sorter 5 according to another embodiment of the present invention. This sorter 5 differs from the foregoing embodiment in that each of the first to fifth bins 51–55 is movably configured so that the order in which the first to fifth bins 51–55 are arranged in the Z-direction can be altered. The other components of the recording device P such as the recording part 2 and the supplying part 3 are configured in the same way as the foregoing embodiment and their description is omitted accordingly.

The sorter 5 has a sheet delivering side region 91 in which each bin 51–55 can be put in the position of the delivering outlet 11*a* of the recording part 2 and an elevating side region 92 defined on the X-direction side with respect to the sheet delivering side region 91 in which each bin 51–55 cannot be put in the position of the delivering outlet 11*a*. Each of the bins 51–55 can individually move between the sheet delivering side region 91 and the elevating side region 92 in the X-direction and can individually move in the Z-direction in the sheet delivering side region 91 as well as in the elevating side region 92.

For example, in the sorter 5 the state in which the first bin 51 directly overlies the second bin 52 can be changed to another state in which the second bin 52 directly overlies the first bin 51. Stated another way, a bin positioned uppermost in the sheet delivering side region 91, i.e., the first bin 51, is shifted in the X-direction to the elevating side region 92. Thereafter, in the elevating side region 92 the first bin 51 is lowered until it is situated under the second bin 52 with respect to the Z-direction. Finally, the first bin 51 is again shifted in the X-direction to the sheet delivering side region 91. As a result, in the sheet delivering side region 91 the second bin 52 overlies the first bin 51 (see arrows and long dashed double-short dashed lines in the figure).

The order in which the bins 51–55 are arranged can be altered, as described above. This makes it possible to shift the first bin 51 in the way described above, for example when new image data is input to the recording device P when the first bin 51 positioned uppermost is already loaded with a record sheet 4. Together with this, the second bin 52 is shifted upwardly in the sheet delivering region 91 so as to be positioned uppermost. Then, the record sheet 4 is delivered onto the second bin 52.

Each bin 51–55 is shifted so that the record sheets 4 are arranged in most-to-least-recent order by output case in the top-to-bottom direction. As a result, it is possible to always deliver new record sheets 4 onto an uppermost, empty bin. Besides, a user is able to easily identify a bin loaded with a record sheet 4 relating to the image data output by the user, thereby improving the convenience of the recording device at the time of use thereof.

Further, in the case each bin 51–55 is configured so that it can be shifted with a record sheet 4 loaded thereon, preferably each bin 51–55 is provided with retaining means 51*c* for retaining the record sheet 4 (only the retaining means 51*c* mounted on the first bin 51 are illustrated in the figure). These retaining means 51*c* may be implemented by members approximately shaped like the plate and pivotally supported on upper end portions of the regulating vertical walls 72. More specifically, each member 51*c* can rotate inwardly of the first bin 51, whereby the record sheet 4 is pinched between the plate-like member 51*c* and the loading surface 71*a* of the first bin 51. The provision of the retaining means Sic ensures that the record sheet 4 on the loading surface 71*a* of each bin 51–55 is prevented from dropping down by wind or the like.

What is claimed is:

1. A recording device configured so as to record an image on a record medium according to image data, said recording device comprising:

two or more recording parts for recording an image on a record medium;

at least one feeding part for supplying record media to each said recording part, and a delivering part for holding image-recorded record media delivered from each of said plural recording parts, wherein said plural recording parts concurrently record images on different record media so that the processing of image data ranging over two or more record media can be shared between said plural recording parts, and wherein said delivering part includes a bin capable of moving between said plural recording parts to receive thereon record media delivered out of each said recording part, and is configured such that record media, which have been image recorded in each of said plural recording parts, are stacked on top of one another in a specific sequence on said bin by causing said bin to move in association with the time of completion of the recording of an image in each said recording part.

2. A recording device configured so as to record an image on a record medium according to image data, said recording device comprising:

two or more recording parts for recording an image on a record medium;

at least one feeding part for supplying record media to each said recording part, and a delivering part for holding image-recorded record media delivered from each of said plural recording parts, wherein said plural recording parts concurrently record images on different record media so that the processing of image data ranging over two or more record media can be shared between said plural recording parts, said delivering part including:

two or more bins respectively corresponding to said plural recording parts on which record media delivered out of each said recording part are loaded, and a transferring means for transferring a record medium between said plural bins, wherein said delivering part is configured such that record media, which have been image recorded in each of said plural recording parts, are loaded on said plural bins corresponding to said plural recording parts, and stacked together, by causing said transferring means to transfer said image-recorded record media onto a specific bin of said plural bins, on top of one another in a specific sequence on said specific bin.

3. A recording device configured so as to record an image on a record medium according to image data, said recording device comprising:

two or more recording parts for recording an image on a record medium, at least one feeding part for supplying record media to each said recording part, and a delivering part for holding image-recorded record media delivered from each of said plural recording parts, wherein said plural recording parts concurrently record images on different record media so that the processing of image data ranging over two or more record media can be shared between said plural recording parts, wherein each said recording part is configured in the form of a unit by accommodating in a housing, and is capable of being stacked together on top of one another and decomposed, and wherein only one mains plug for supplying electric power to each said recording part is provided.

4. The recording device of claim 3, wherein each said unit-like recording part is electrically connected to said mains plug when stacked together on top of one another.

5. A recording device configured so as to record an image on a record medium according to image data, said recording device comprising:

two or more recording parts for recording an image on a record medium;

at least one feeding part for supplying record media to each said recording part, and a delivering part for holding image-recorded record media delivered from each of said plural recording parts, wherein said plural recording parts concurrently record images on different record media so that the processing of image data ranging over two or more record media can be shared between said plural recording parts, and wherein said plural recording parts are configured such that the timing at which the power consumption of each said recording part increases to a maximum is differed from that of every other recording part by mutual adjustment of the operating timing of recording an image in each said recording part.

6. The recording device of claim 3, wherein a single power supply switch for switching on and off the supply of electric power to said recording parts is provided, and wherein electric power is supplied to all of said recording parts by switching on said power supply switch.

7. A recording device configured so as to record an image on a record medium according to image data, said recording device comprising:

two or more recording parts for recording an image on a record medium;

at least one feeding part for supplying record media to each said recording part, and a delivering part for holding image-recorded record media delivered from each of said plural recording parts, wherein said plural recording parts concurrently record images on different record media so that the processing of image data ranging over two or more record media can be shared between said plural recording parts, wherein only one mains plug for supplying electric power to each said recording part is provided, wherein two or more power supply switches for switching on and off the supply of electric power to said recording parts are provided in association with said recording parts, and wherein electric power is supplied, by switching on each said power supply switch, to its corresponding recording part.

8. A recording device configured so as to record an image on a record medium according to image data, said recording device comprising:

two or more recording parts for recording an image on a record medium;

at least one feeding part for supplying record media to each said recording part, and a delivering part for holding image-recorded record media delivered from each of said plural recording parts, and a single displaying means for displaying recording part operating states, wherein said displaying means is so configured as to display the operating state of all of said recording parts, and wherein said plural recording parts concurrently record images on different record media so that the processing of image data ranging over two or more record media can be shared between said plural recording parts.

9. A recording device configured so as to record an image on a record medium according to image data, said recording device comprising:

two or more recording parts for recording an image on a record medium;

at least one feeding part for supplying record media to each said recording part, and a delivering part for holding image-recorded record media delivered from each of said plural recording parts, and two or more displaying means for displaying recording part operating states, said plural displaying means being provided in association with said recording parts, wherein each said displaying means is so configured as to display the operating state of its corresponding recording part, and wherein said plural recording parts concurrently record images on different record media so that the processing of image data ranging over two or more record media can be shared between said plural recording parts.

10. The recording device of claim 9, wherein power supply switches for switching on and off the supply of electric power to said recording parts are provided in association with said recording parts, and wherein each said displaying means, even when said power supply switch of its corresponding recording part is switched off, is so configured as to be able to display the operating state of said corresponding recording part.

11. An ink jet recording device configured so as to record, by emitting ink onto a record medium according to image data, an image on said record medium, wherein two or more unit-like recording parts, each of which is provided with a recording part having an ink jet head for emitting ink and a housing accommodating the recording part, are stacked together on top of one another in an up and down direction, and wherein an opening, through which maintenance work is performed on each said recording part, is formed in a side of each said housing.

12. The ink jet recording device of claim 11 further comprising:

an access cover capable of opening and closing said opening of each said housing, wherein said plural housings are provided with a single common access cover.

13. An ink jet recording device configured so as to record, by emitting ink onto a record medium according to image data, an image on said record medium, wherein two or more unit-like recording parts, each of which is provided with a recording part having an ink jet head for emitting ink, are stacked together on top of one another in an up and down direction, and wherein an opening, through which maintenance work is performed on each said unit-like recording part, is formed in a side of each said unit-like recording part, wherein each said unit-like recording part is provided with an ink tank for holding ink that is supplied to said ink jet head thereof, and wherein said maintenance work on each said unit-like recording part is the replacement of said ink tank.

14. The ink jet recording device of claim 13, wherein each said unit-like recording part is provided with a sub tank formed integrally with said ink jet head thereof and a main ink tank connected to said sub tank, and wherein said maintenance work on each said unit-like recording part is the replacement of said main ink tank.

15. An ink jet recording device configured so as to record, by emitting ink onto a record medium according to image data, an image on said record medium, wherein two or more unit-like recording parts, each of which is provided with a recording part having an ink jet head for emitting ink, are stacked together on top of one another in an up and down direction, and wherein an opening, through which maintenance work is performed on each said unit-like recording part, is formed in a side of each said unit-like recording part, wherein each said unit-like recording part is provided with a feeding part for accommodating a record medium and for feeding said record medium to said recording part, and wherein said maintenance work on each said unit-like recording part is the supply of record media to said feeding part.

16. An ink jet recording device configured so as to record, by emitting ink onto a record medium according to image data, an image on said record medium, said ink jet recording device comprising:

two or more recording parts each of which is provided with an ink jet head for emitting ink, and a single ink tank for holding ink that is supplied to each said ink jet head.

17. The ink jet recording device of claim 16, wherein said plural recording parts are horizontally arranged side by side, and wherein said ink jet heads of said recording parts are positioned at approximately the same height with respect to said ink tank.

18. The ink jet recording device of claim 16, wherein said plural recording parts are stacked together on top of one another in an up and down direction, and wherein said ink jet recording device further comprises an adjusting means for providing adjustment so that ink suction pressures in said ink jet heads of said plural recording parts become approximately the same.

19. The ink jet recording device of claim 18, wherein said ink jet heads are connected to said ink tank by different supplying tubes, wherein said ink tank is vertically divided into two or more ink chambers corresponding to said supplying tubes and each pair of adjacent ink chambers of said plural ink chambers are communicated together through a respective switch valve, and wherein said adjusting means comprises:

mounting holes for said supplying tubes, said mounting holes being positioned in said ink chambers at such heights that vertical distances between said mounting holes and their corresponding ink jet heads are approximately the same, and said switch valves which are placed in the closed state at least during ink emission in said ink jet head.

20. The ink jet recording device of claim 19, wherein the opening and closing of said switch valves is controlled such that all of said switch valves are not placed in the opened state at the same time during non ink emission in said ink jet head.

21. An ink jet recording device configured so as to record, by emitting ink onto a record medium according to image data, an image on said record medium, said ink jet recording device comprising:

two or more recording parts each of which is provided with an ink jet head capable of emitting ink onto a record medium while reciprocating with respect to said record medium, wherein said plural recording parts are stacked together on top of one another in an up and down direction so that said ink jet heads of said recording parts can reciprocate in the same direction, and wherein said recording parts are configured such that said ink jet heads of said recording parts are reciprocated out of phase with respect to each other so as to reduce vibration due to the reciprocating movement of said ink jet heads.

22. The ink jet recording device of claim 21, wherein said recording parts are configured such that, when each said recording part makes no record of images, its corresponding ink jet head is reciprocated, without ink emission, out of phase with respect to the reciprocating movement of the other ink jet heads.

23. A sorter with two or more bins each having an upward loading surface on which a record medium is loaded wherein record media, which have been image recorded in recording parts, are loaded on said different bins so that said record media are sorted, said sorter comprising:

a transferring means for transferring a record medium between said plural bins.

24. The sorter of claim 23, wherein said plural bins are arranged side by side in an up and down direction, and wherein said transferring means is so configured as to cause a record medium on said loading surface of each said bin to drop down for transferring said record medium to another bin directly underlying each said bin.

25. The sorter of claim 24, wherein said transferring means comprises a pair of wail members which are arranged face to face with each other, said pair of wall members being movable so as to switch between a proximity state in which said wall members are brought into close proximity to each other to form said bin loading surface and a clearance state in which said wall members are moved away from each other so as to allow a record medium to drop down.

26. The sorter of claim 24, wherein said transferring means comprises a wall member which is pivotably supported on one side end of each said bin so that said wall member is rotatable so as to switch between a state in which said bin loading surface is formed and a state in which a record medium is allowed to drop down.

27. The sorter of claim 24, wherein said transferring means comprises a pair of wall members which are arranged face to face with each other, said pair of wall members being expandable and contractible so as to switch between an expanded state in which said wall members expand in the direction in which said wall members move toward each other to form said bin loading surface and a contracted state in which said wall members contract in the direction in which said wall members move away from each other so as to allow a record medium to drop down.

28. The sorter of claim 24, wherein a storing part for storing image-recorded record media is positioned under a lowermost one of said plural bins.

29. The sorter of claim 24, wherein a lowermost one of said plural bins is so configured as to serve also as a storing part for storing image-recorded record media.

30. The sorter of claim 23, wherein a displaying means is positioned in each said bin or in the vicinity of each said bin, said displaying means displaying an indication that specifies a record medium loaded on said bin loading surface, and wherein each said displaying means is so configured as to change its display contents in association with the transferring of said record medium.

31. A sorter, in which two or more bins each having an upward loading surface on which a record medium is loaded are arranged side by side, for loading record media, which have been image recorded in recording parts, on said different bins so that said record media are sorted, wherein said bins are each movably configured so that the order in which said bins are arranged can be changed.

32. The sorter of claim 31, wherein each said bin has a retaining means for retaining a record medium loaded on said bin loading surface during bin movement.

* * * * *

UNITED STATES PATENT AND TRADEMARK OFFICE

CERTIFICATE OF CORRECTION

PATENT NO. : 6,758,545 B2
DATED : July 6, 2004
INVENTOR(S) : Koji Ikeda et al.

It is certified that error appears in the above-identified patent and that said Letters Patent is hereby corrected as shown below:

Title page,
Item [75], Inventors, "Masaichiro Takekawa, Minoo (JP)" should be -- Masaichiro Tatekawa, Minoo (JP) --.

Signed and Sealed this

Twenty-fourth Day of May, 2005

JON W. DUDAS
*Director of the United States Patent and Trademark Office*